US012543908B2

(12) United States Patent
Park et al.

(10) Patent No.: US 12,543,908 B2
(45) Date of Patent: Feb. 10, 2026

(54) STATION AND DUST REMOVAL SYSTEM INCLUDING THE SAME

(71) Applicant: LG ELECTRONICS INC., Seoul (KR)

(72) Inventors: Hyunwoo Park, Seoul (KR); Jeahyuk Wie, Seoul (KR); Haerim Bak, Seoul (KR); Youngsoo Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 649 days.

(21) Appl. No.: 17/919,378

(22) PCT Filed: Apr. 15, 2021

(86) PCT No.: PCT/KR2021/004752
§ 371 (c)(1),
(2) Date: Oct. 17, 2022

(87) PCT Pub. No.: WO2021/210930
PCT Pub. Date: Oct. 21, 2021

(65) Prior Publication Data

US 2023/0172415 A1 Jun. 8, 2023

(30) Foreign Application Priority Data

Apr. 17, 2020 (KR) ..... 10-2020-0046879

(51) Int. Cl.
*A47L 9/28* (2006.01)

(52) U.S. Cl.
CPC ..... *A47L 9/2873* (2013.01); *A47L 9/2805* (2013.01); *A47L 2201/024* (2013.01)

(58) Field of Classification Search
CPC . A47L 9/2873; A47L 9/2805; A47L 2201/024
See application file for complete search history.

(56) References Cited

U.S. PATENT DOCUMENTS

| | | | | |
|---|---|---|---|---|
| 9,788,698 | B2 * | 10/2017 | Morin | A47L 9/106 |
| 10,506,905 | B2 * | 12/2019 | Son | A47L 5/36 |
| 2007/0226949 | A1 * | 10/2007 | Hahm | A47L 9/009 15/340.1 |
| 2008/0201895 | A1 * | 8/2008 | Kim | A47L 9/106 901/1 |

(Continued)

FOREIGN PATENT DOCUMENTS

| | | | | |
|---|---|---|---|---|
| CN | 101061929 A | * | 10/2007 | A47L 9/00 |
| CN | 110325088 A | * | 10/2019 | A47L 11/4011 |

(Continued)

*Primary Examiner* — Marc Carlson
(74) *Attorney, Agent, or Firm* — Birch, Stewart, Kolasch & Birch, LLP

(57) ABSTRACT

A station and a dust removal system including the same are provided. The station according to one aspect of the present specification is a station to which a cleaner including a dust bin and a body cover selectively opening and closing a lower part of the dust bin is coupled, including a coupling body to which the dust bin is coupled and forms a predetermined angle with a ground; a separating unit which separates the body cover from the dust bin; a driving unit which rotates the coupling body horizontally to the ground; and a dust storage unit which is disposed under the coupling body.

20 Claims, 24 Drawing Sheets

(56) References Cited

U.S. PATENT DOCUMENTS

| | | | | |
|---|---|---|---|---|
| 2009/0049640 | A1* | 2/2009 | Lee | A47L 9/20 901/1 |
| 2011/0219566 | A1* | 9/2011 | Dyson | H02J 7/0044 15/323 |
| 2014/0137364 | A1* | 5/2014 | Stickney | A47L 5/24 15/347 |
| 2016/0106284 | A1* | 4/2016 | Mantyla | A47L 9/149 134/21 |
| 2017/0196430 | A1* | 7/2017 | Machida | A47L 7/0047 |
| 2017/0280951 | A1* | 10/2017 | Nam | A47L 9/1641 |
| 2017/0319035 | A1* | 11/2017 | Kim | A47L 5/24 |
| 2018/0132685 | A1* | 5/2018 | Muir | A47L 9/149 |
| 2018/0177358 | A1* | 6/2018 | Conrad | B65F 1/105 |
| 2018/0296051 | A1* | 10/2018 | Jung | A47L 9/2815 |
| 2020/0107685 | A1* | 4/2020 | Tanaka | A47L 9/108 |
| 2020/0315419 | A1* | 10/2020 | Sato | A47L 5/36 |
| 2020/0329933 | A1* | 10/2020 | Hackert | A47L 7/0038 |
| 2020/0345196 | A1* | 11/2020 | Innes | A47L 9/1683 |
| 2021/0052121 | A1* | 2/2021 | Kim | A47L 9/30 |
| 2021/0345848 | A1* | 11/2021 | Jeon | A47L 9/0063 |
| 2023/0060474 | A1* | 3/2023 | Kim | A47L 9/0063 |

FOREIGN PATENT DOCUMENTS

| | | | | | |
|---|---|---|---|---|---|
| CN | 113317716 | A | * | 8/2021 | |
| DE | 102010038095 | A1 | * | 4/2012 | A47L 5/24 |
| DE | 102019004417 | A1 | * | 12/2020 | A47L 5/30 |
| EP | 3517012 | A1 | * | 7/2019 | A47L 9/149 |
| JP | 2004283327 | A | * | 10/2004 | |
| JP | 2008079922 | A | * | 4/2008 | |
| JP | 2014-30545 | A | | 2/2014 | |
| JP | 2014030545 | A | * | 2/2014 | |
| JP | 2016116850 | A | * | 6/2016 | A47L 5/38 |
| JP | 2017158806 | A | * | 9/2017 | |
| JP | 2017189453 | A | * | 10/2017 | |
| JP | 2017537743 | A | * | 12/2017 | |
| JP | 2018511387 | A | * | 4/2018 | |
| KR | 10-2007-0010298 | A | | 1/2007 | |
| KR | 20070010298 | A | * | 1/2007 | |
| KR | 20070094288 | A | * | 9/2007 | |
| KR | 20070106864 | A | * | 11/2007 | |
| KR | 20120046928 | A | * | 5/2012 | |
| KR | 20170126379 | A | * | 11/2017 | |
| KR | 10-2019-0099868 | A | | 8/2019 | |
| KR | 20190099868 | A | * | 8/2019 | |
| WO | WO-2019180938 | A1 | * | 9/2019 | A45D 20/10 |
| WO | WO-2020122631 | A1 | * | 6/2020 | A47L 5/18 |

* cited by examiner

【Figure 1】
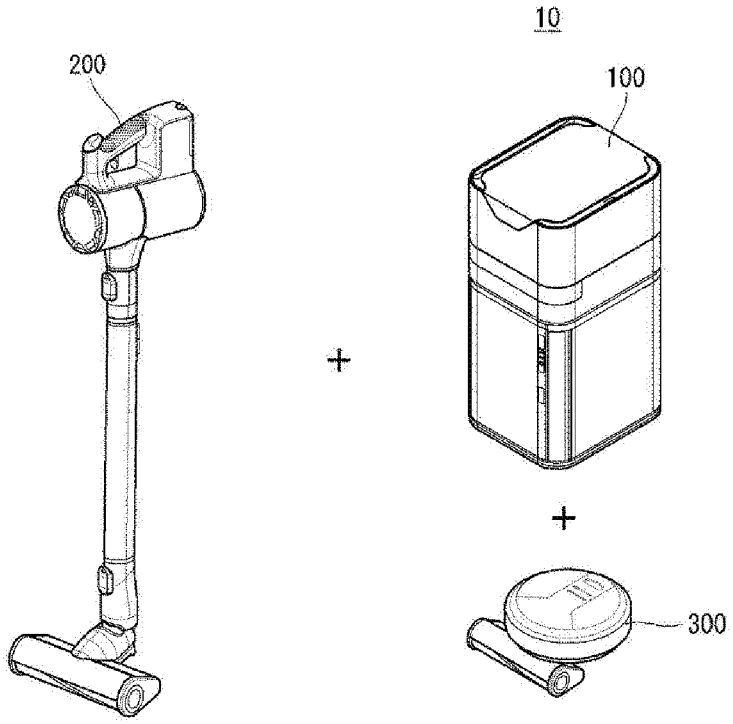

【 Figure 2】
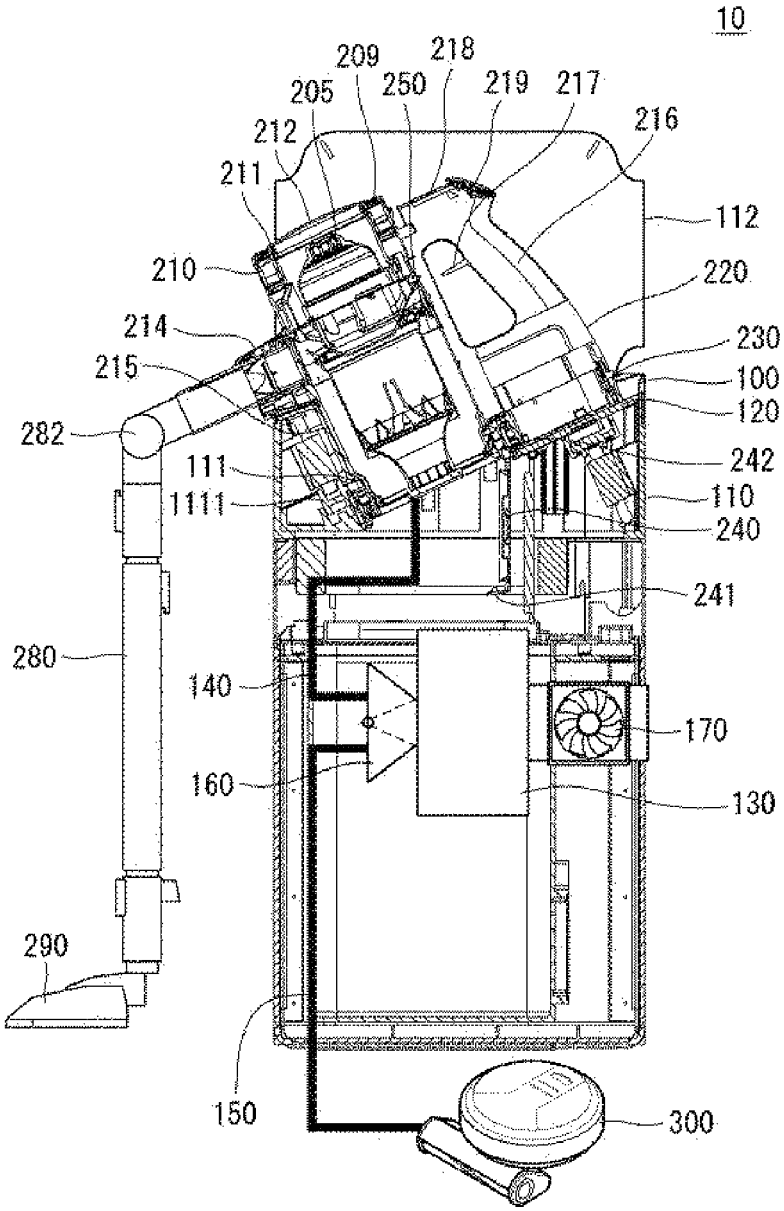

【Figure 3】
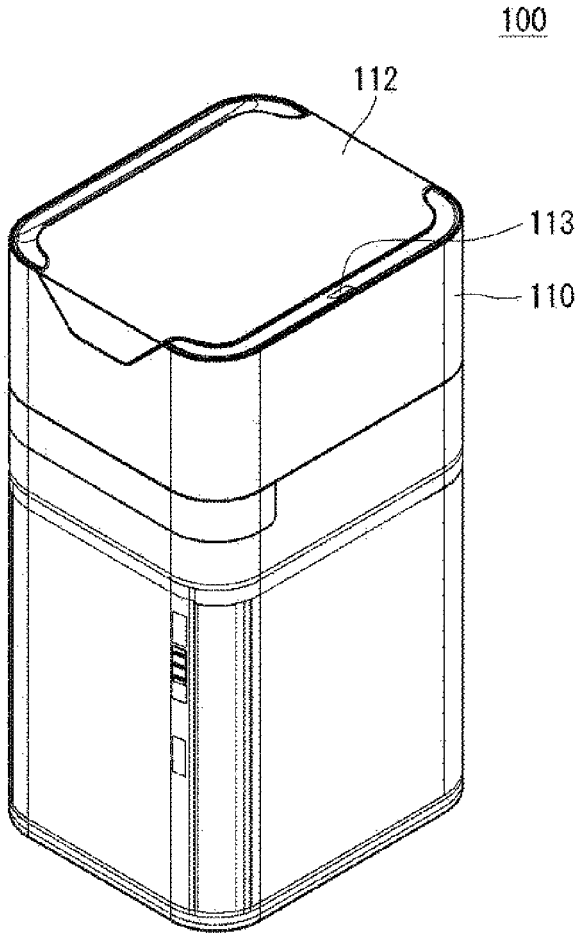

【Figure 4】
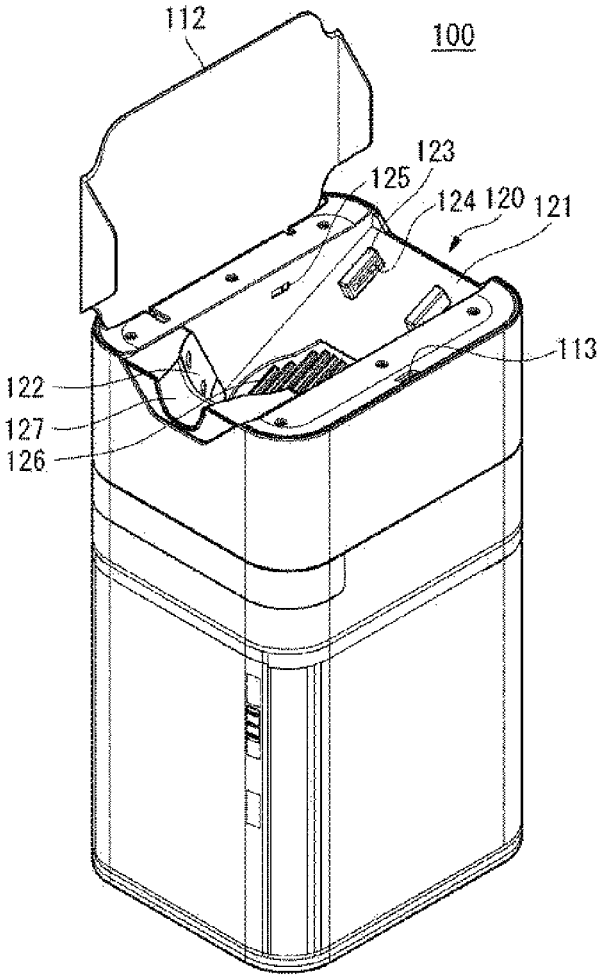

【Figure 5】
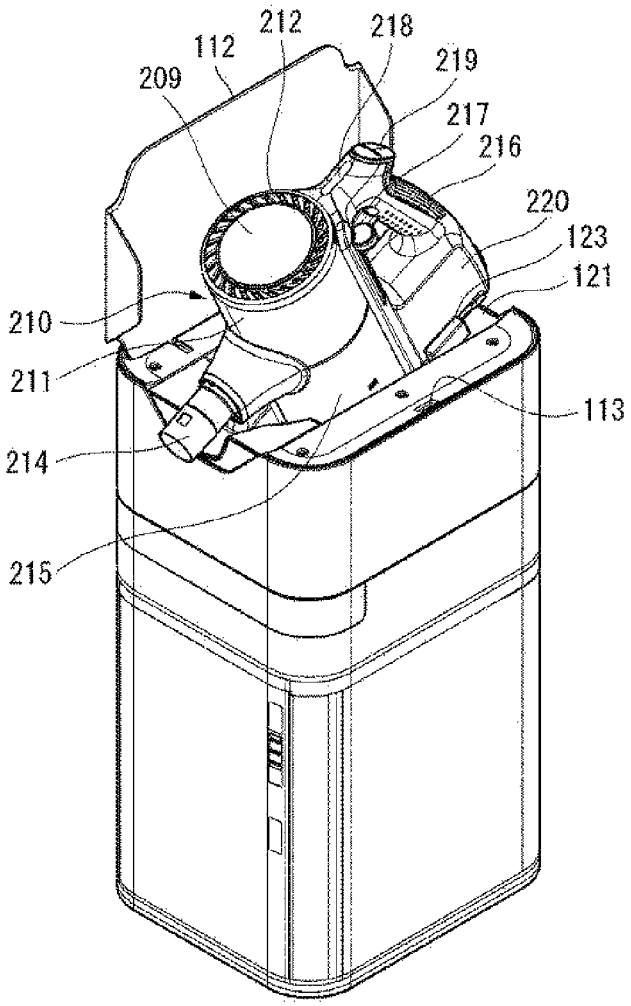

【Figure 6】
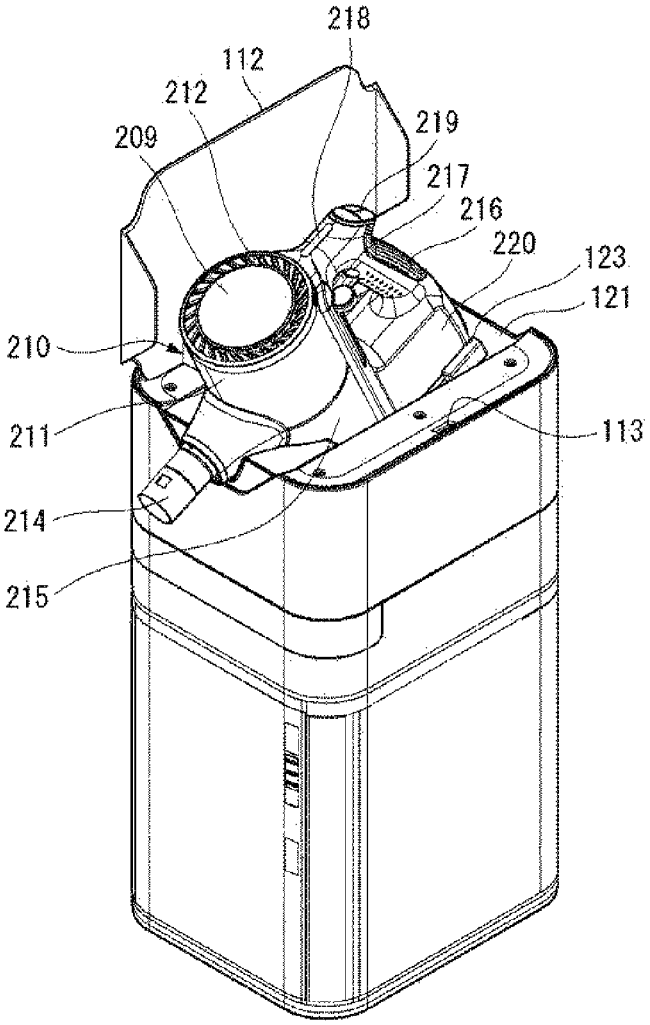

【Figure 7】
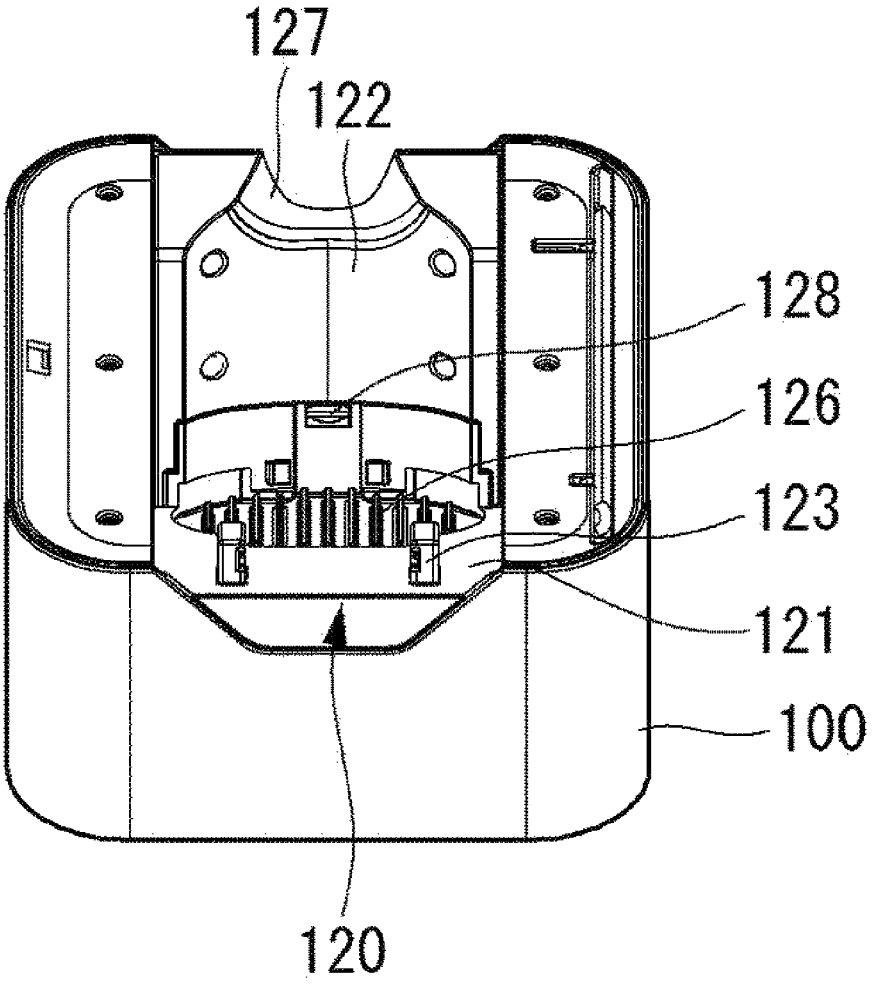

【Figure 8】
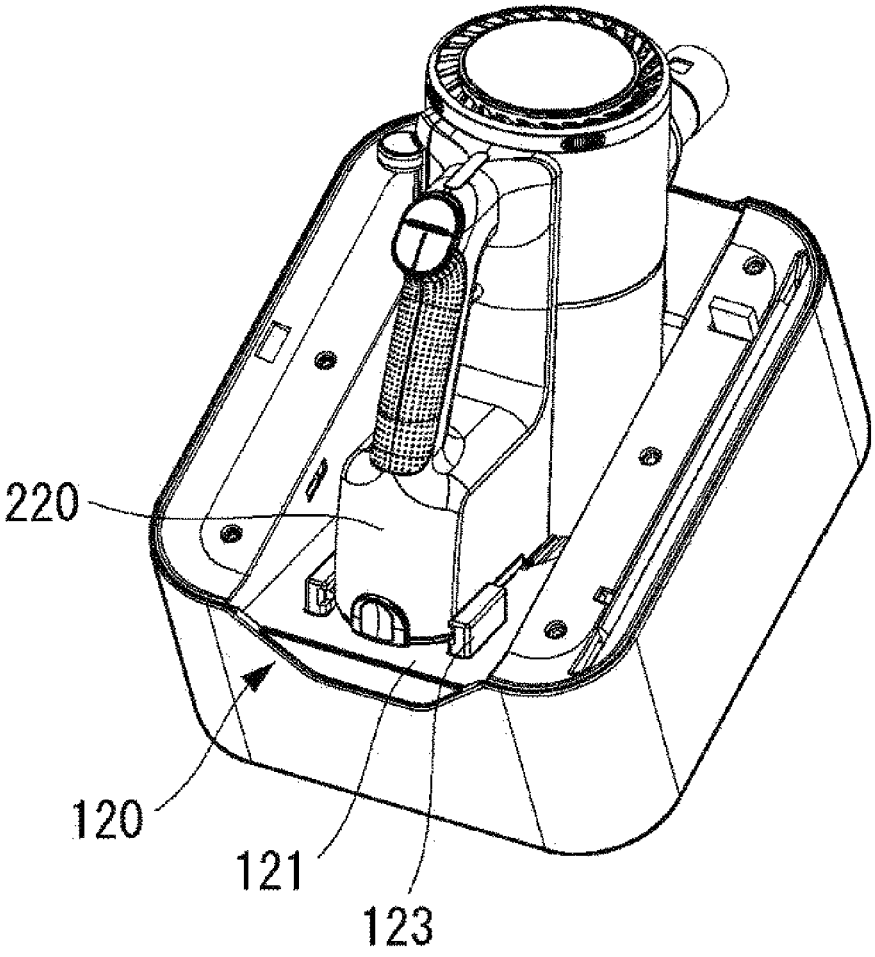

【 Figure 9】
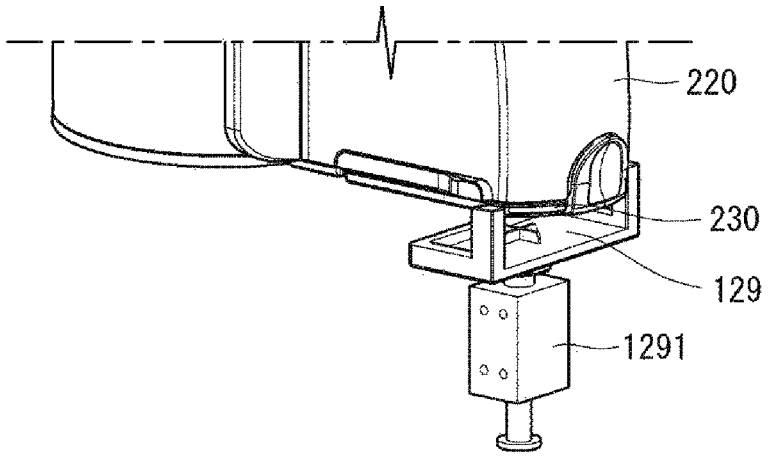
【 Figure 10】
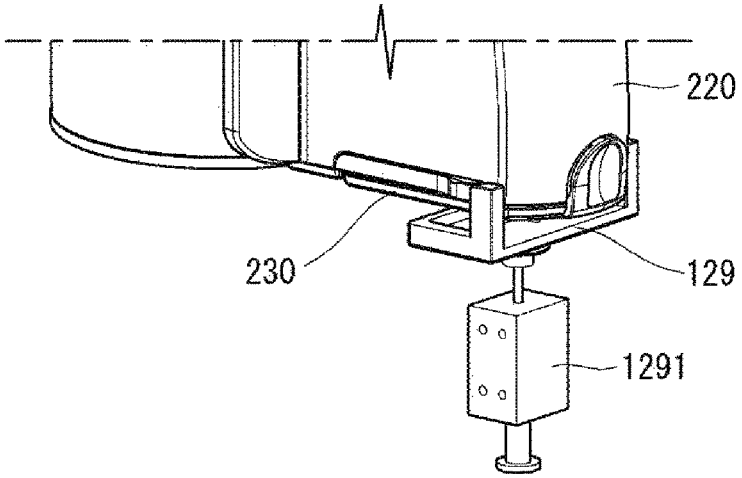

【 Figure 11】
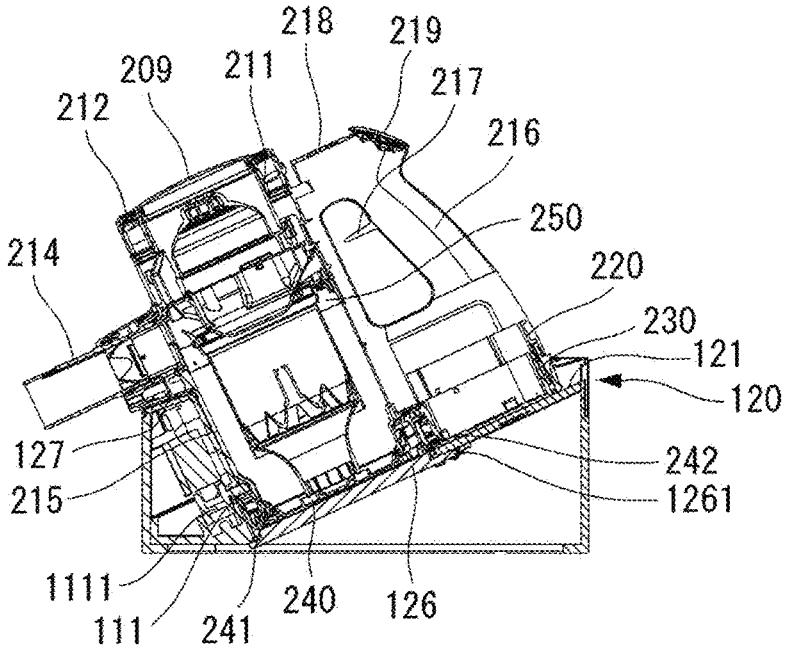
【 Figure 12】
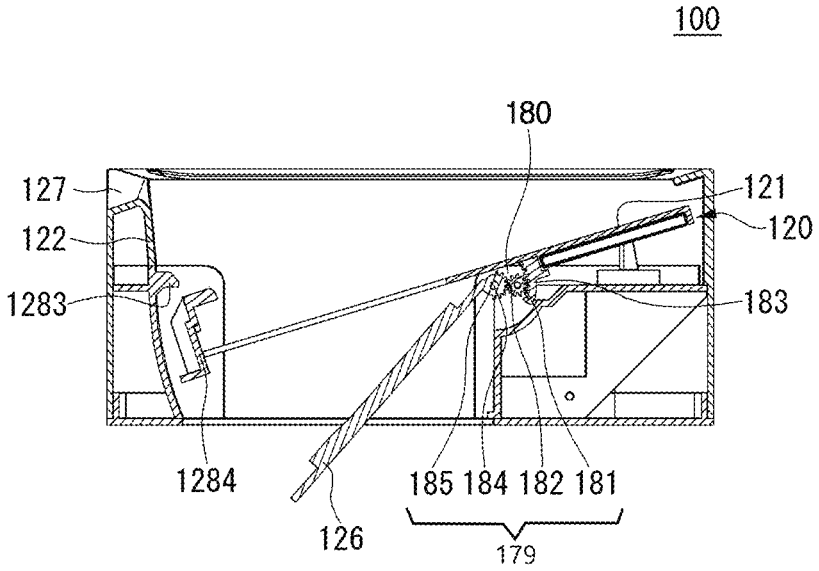

【Figure 13】
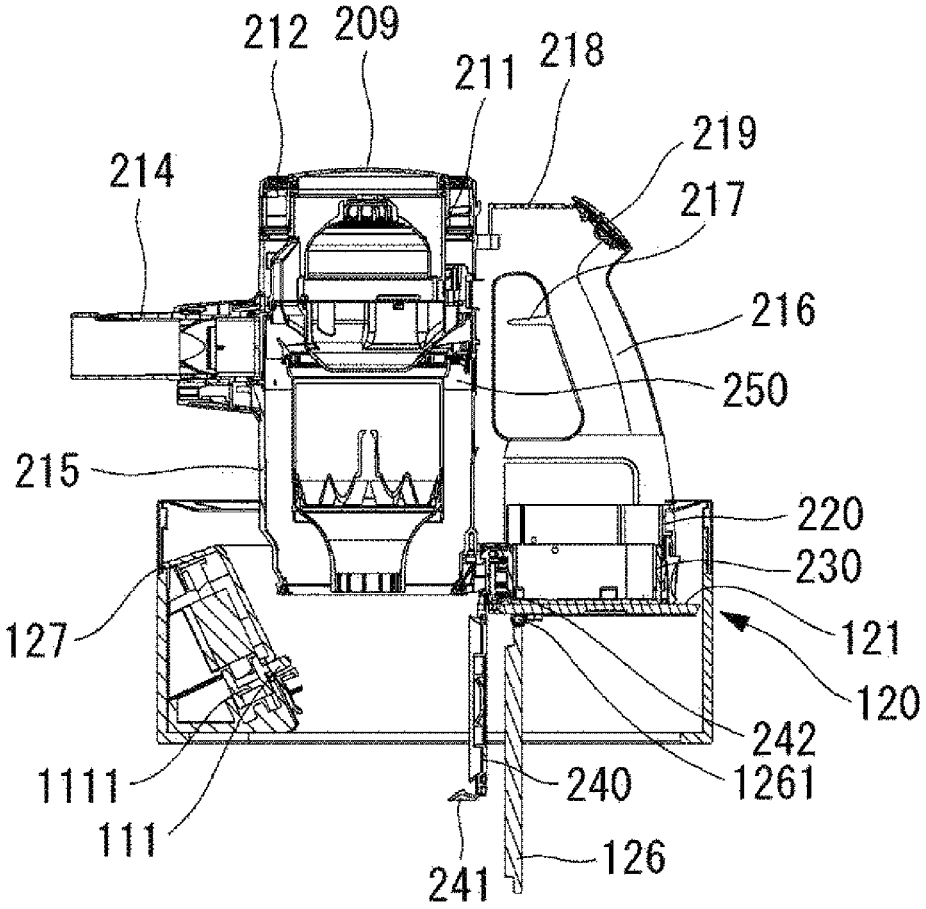

【Figure 14】
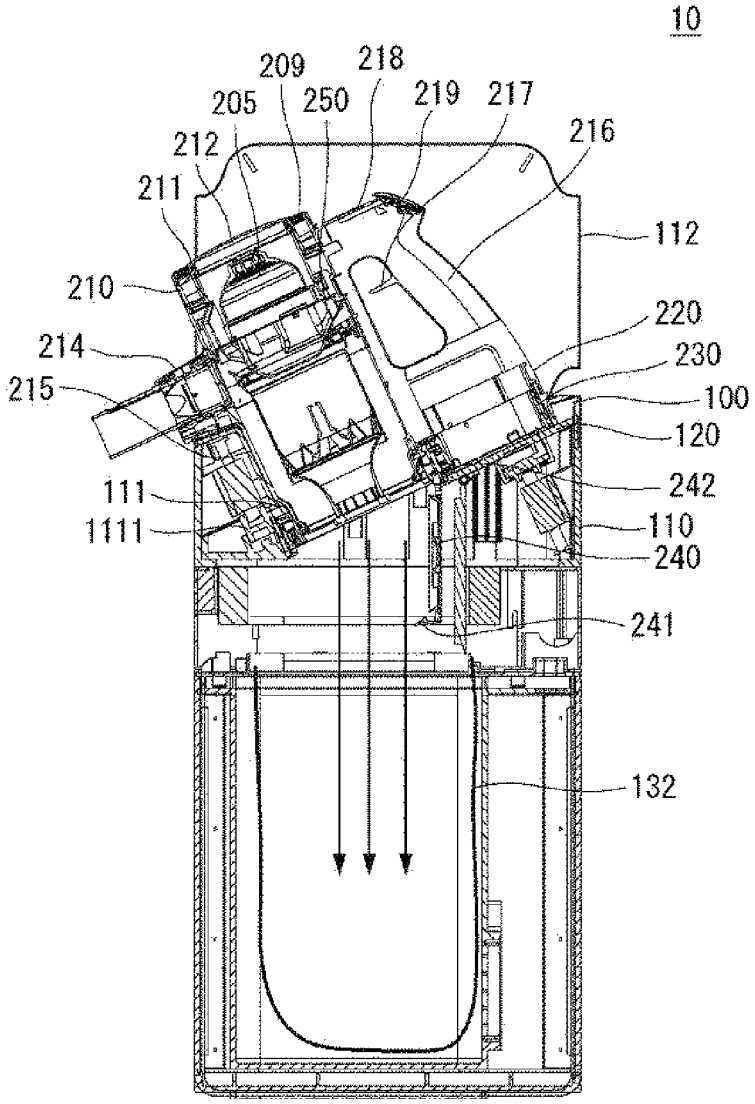

【 Figure 15】
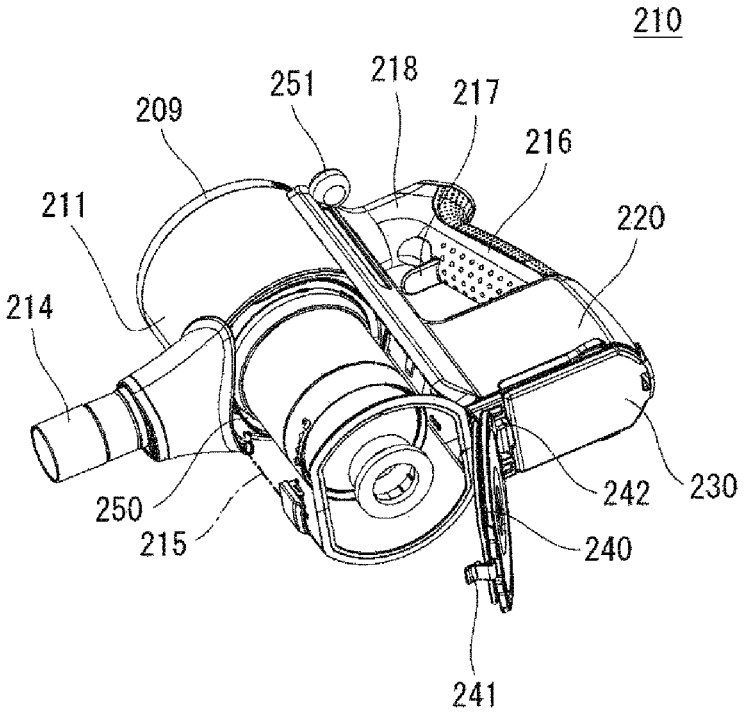
【 Figure 16】
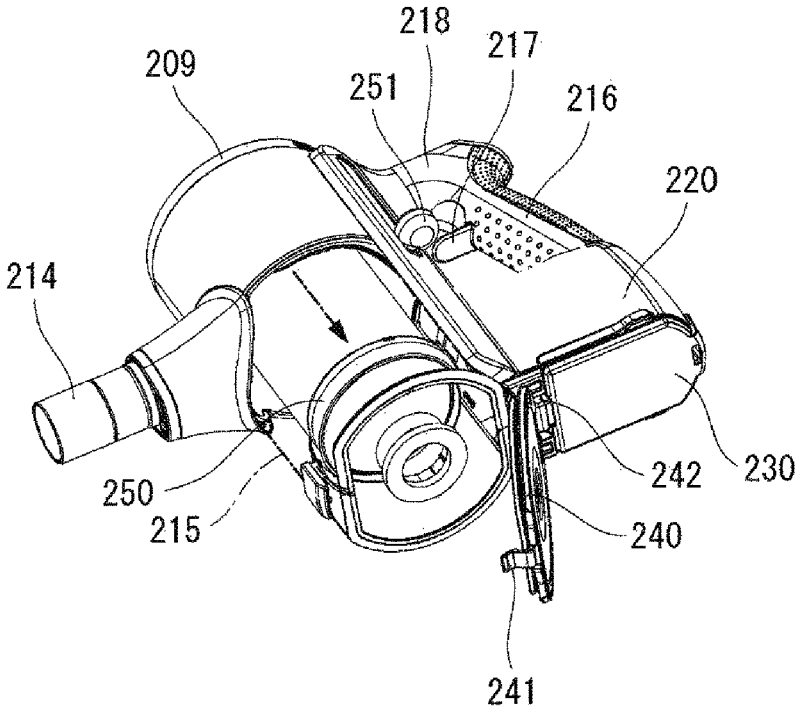

【Figure 17】
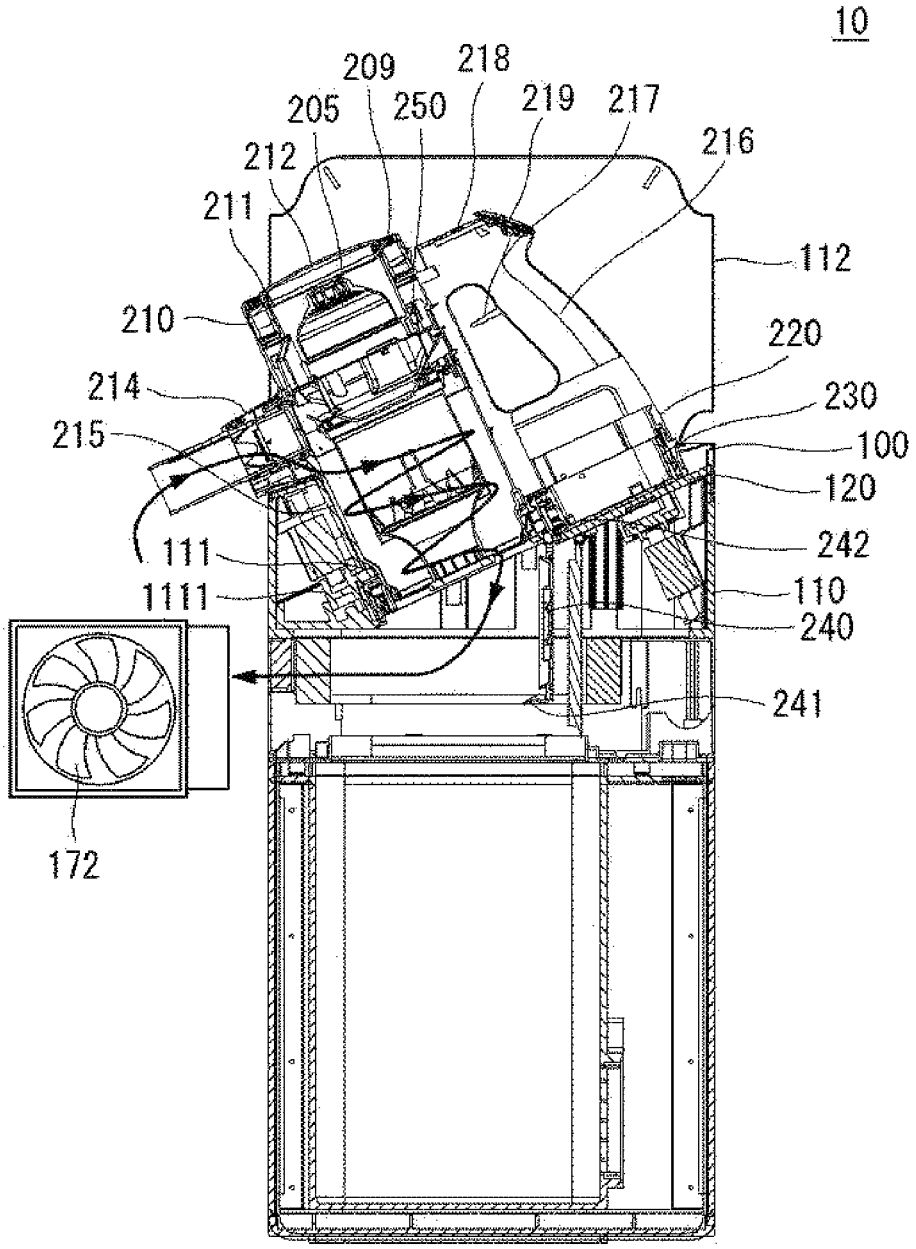

【 Figure 18】
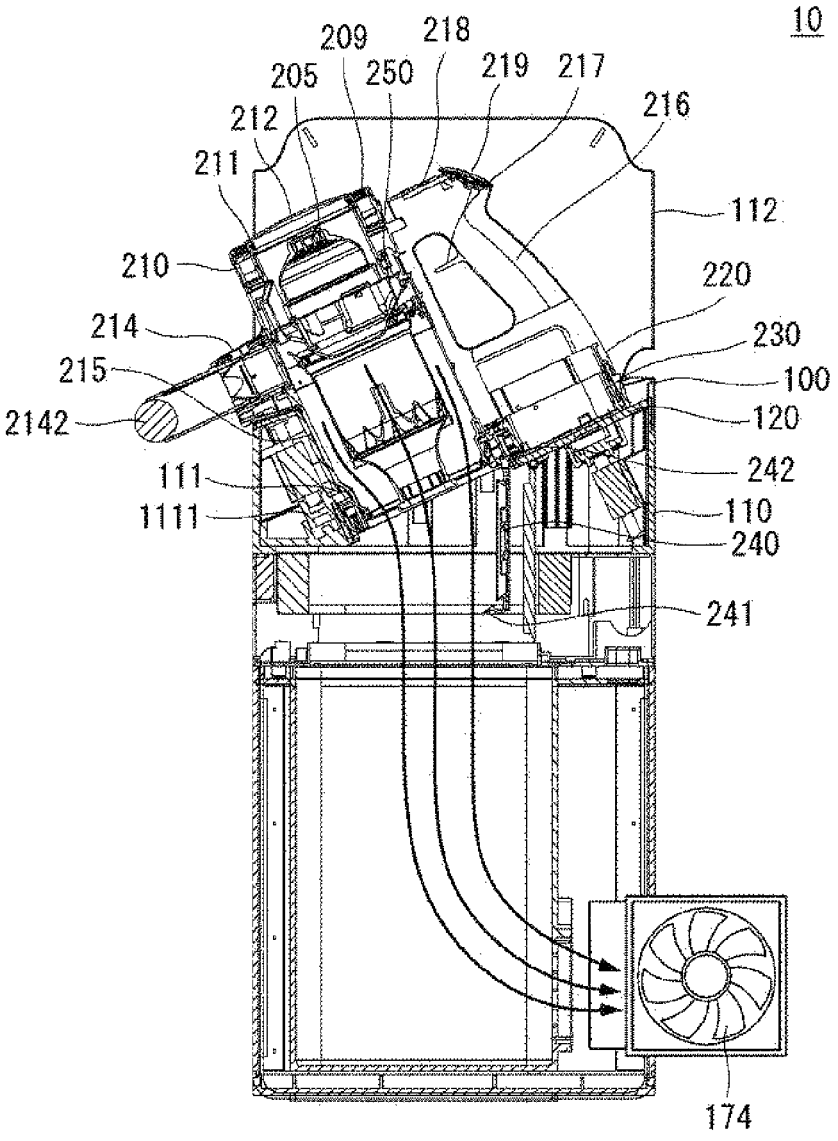

【Figure 19】
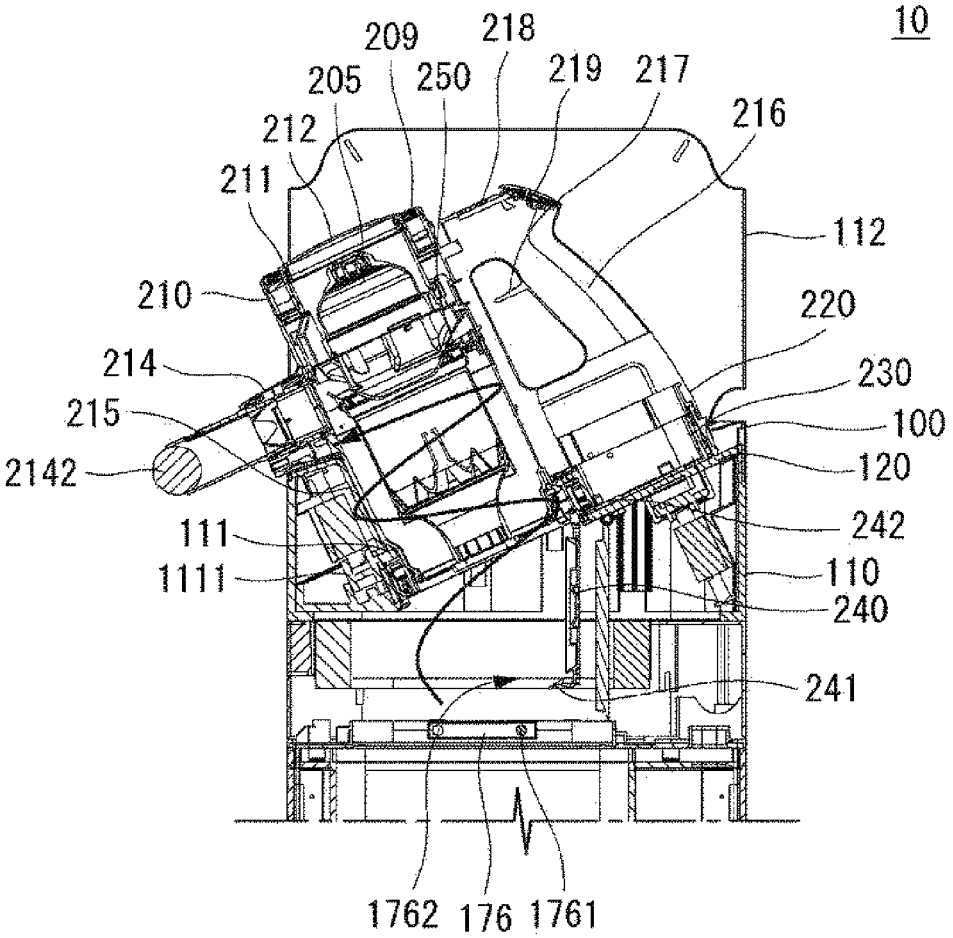

【 Figure 20】
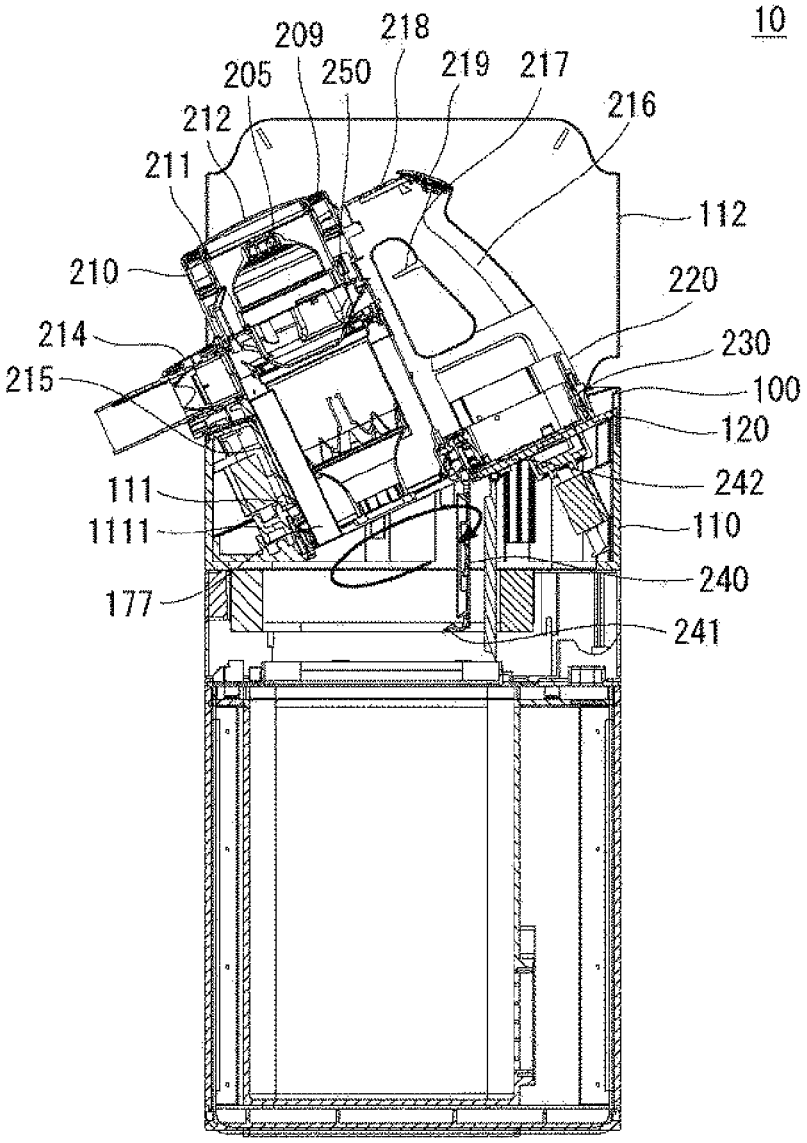

【 Figure 21】
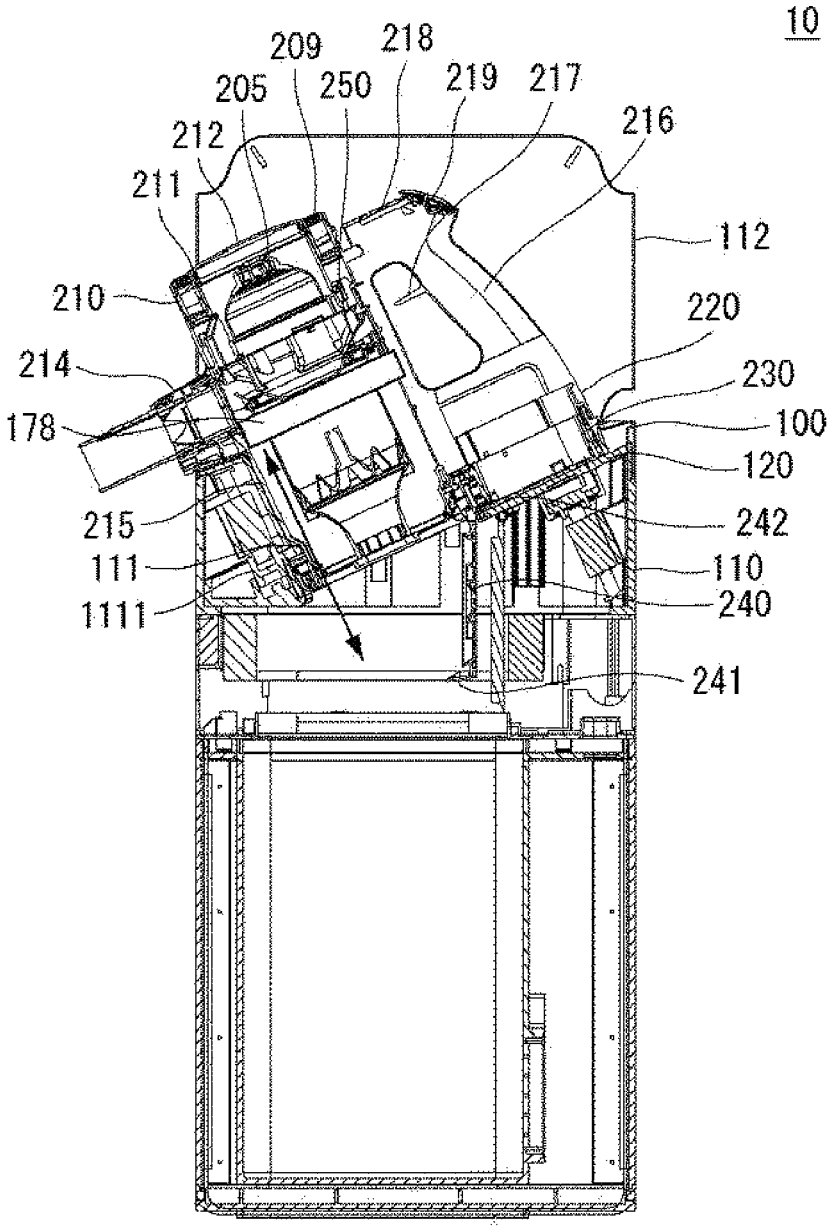

【 Figure 22】
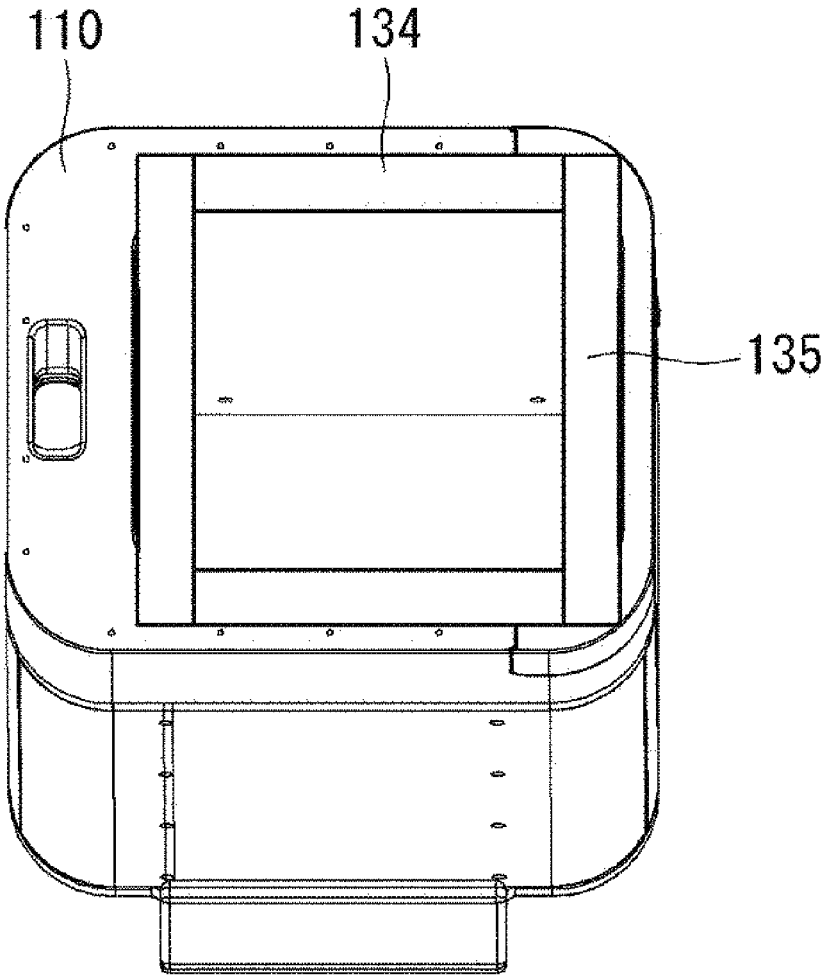

【Figure 23】
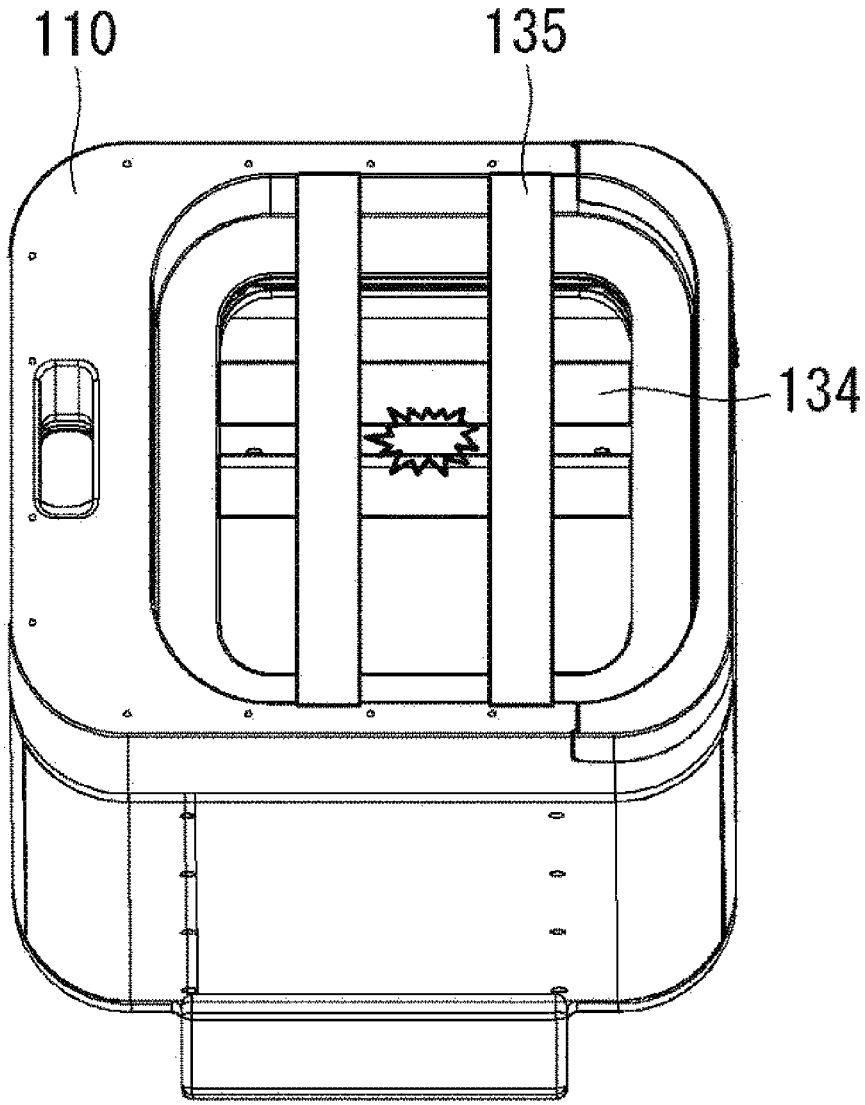

【Figure 24】
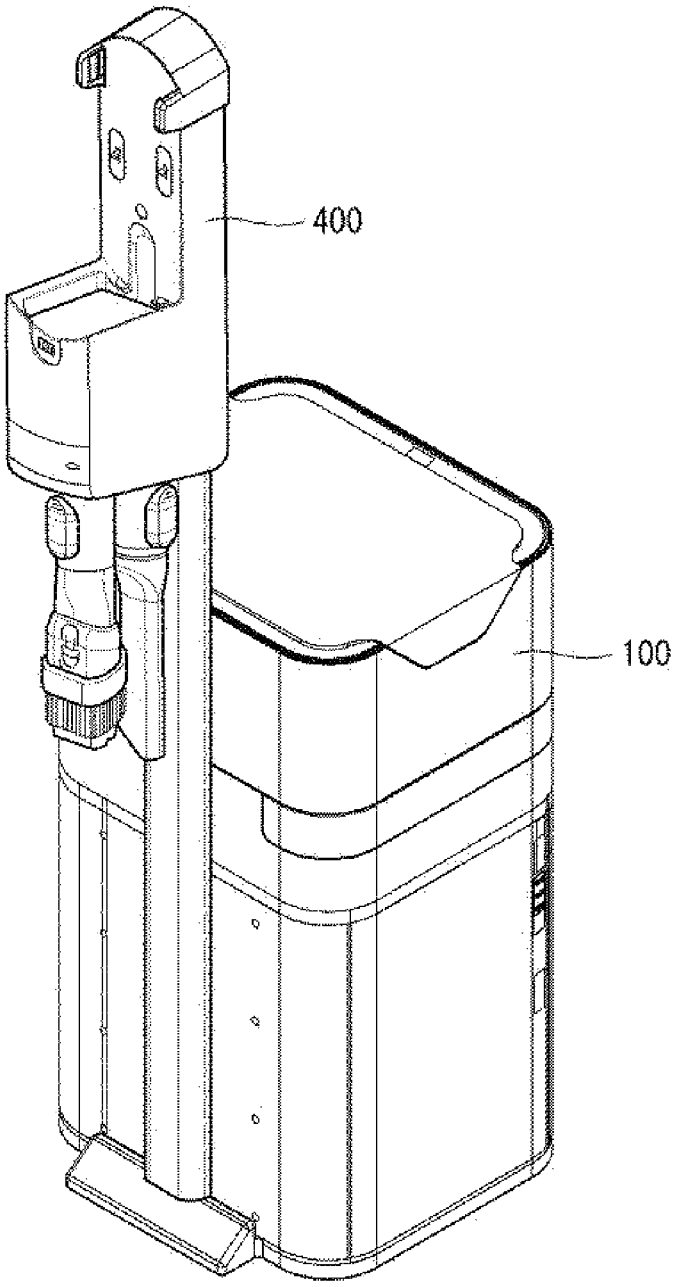

【 Figure 25】
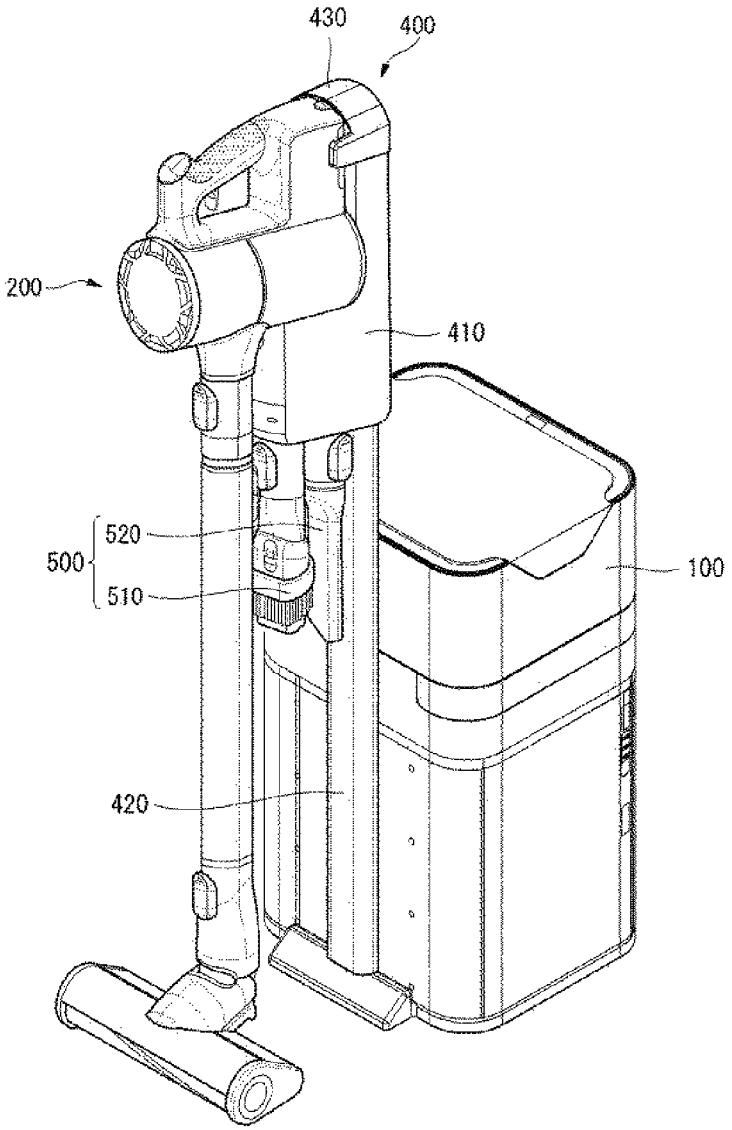

【 Figure 26】
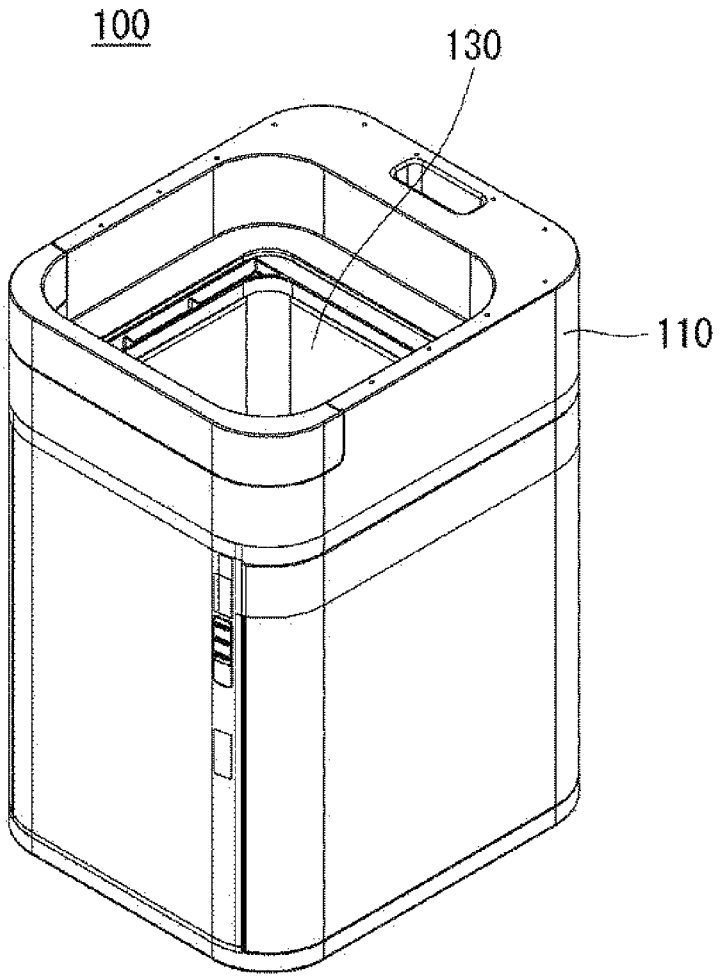

【Figure 27】
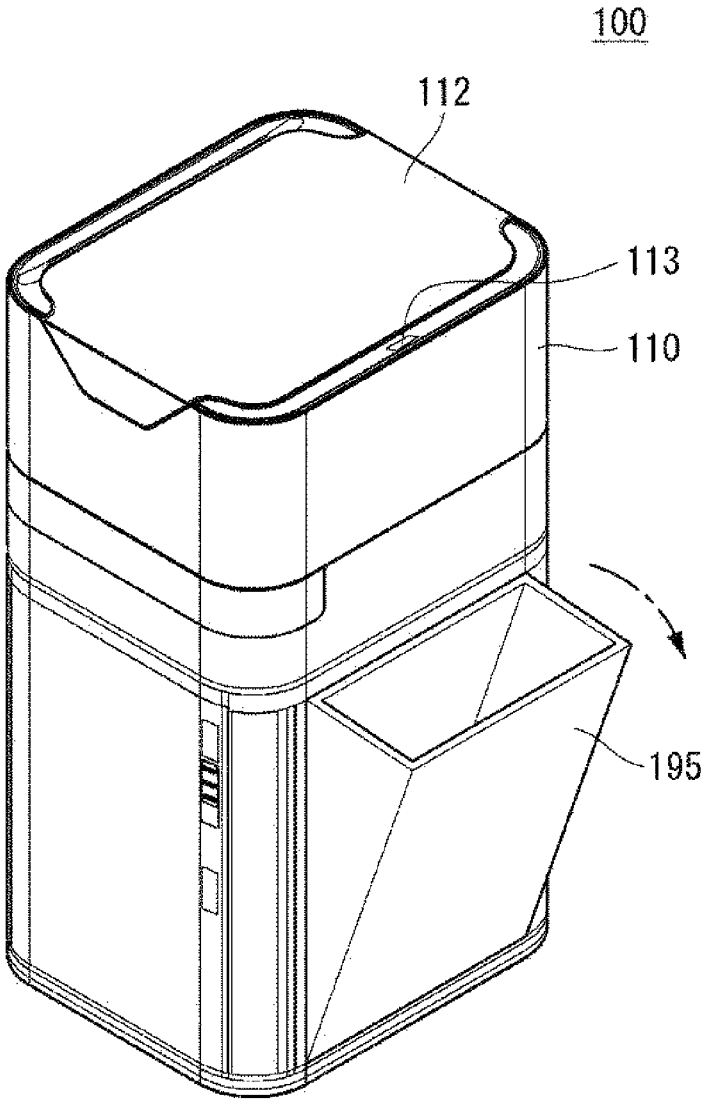

STATION AND DUST REMOVAL SYSTEM INCLUDING THE SAME

CROSS REFERENCE TO RELATED APPLICATIONS

This application is the National Phase of PCT/KR2021/004752 filed on Apr. 15, 2021, which claims priority under 35 U.S.C. § 119 (a) to Patent Application No. 10-2020-0046879 filed in the Republic of Korea on Apr. 17, 2020, all of which are hereby expressly incorporated by reference into the present application.

TECHNICAL FIELD

The present disclosure relates to a docking station and a dust removal system including the same, and more particularly, to a docking station for collecting the dust stored in a cleaning apparatus and a dust removal system including the same.

BACKGROUND ART

Generally, a cleaner is a household appliance which uses an electrical energy to suck small garbage or dust into a dust bin of the machine by inhaling air, and is generally called a vacuum cleaner.

Cleaners may be classified into a manual cleaner for cleaning while a user directly moves the machines, and an autonomous cleaner for cleaning while driving by itself. Manual cleaners may be classified into cannister vacuum cleaners, uplight cleaners, hand vacuum cleaners, and stick vacuum cleaners depending on the shape of the cleaners.

Traditionally cannister vacuum cleaners have been widely used as household vacuum cleaners, but in recent years, hand vacuum cleaners or stick vacuum cleaners, which have improved ease of use by providing a dust bin and cleaning body, are a trend.

In cannister vacuum cleaners a main body and an inlet are connected by a rubber hose or pipe, and in some cases a brush may be inserted into the inlet.

Hand Vacuum Cleaners can maximize portability, but, due to they are light in weight and short in length, so there may be restrictions on the area to sit and clean. Therefore, it is generally used for cleaning a local area such as a desk, a sofa or inside the car.

Stick vacuum cleaners can be used while standing, and thus a user can operate stick vacuum cleaners without bending her or his waste. Thus, it can be used for moving and cleaning a large area. While hand vacuum cleaners clean a small space, stick vacuum cleaners can clean a wider space than that, and can clean a high place out of reach. Recently, module type stick vacuum cleaners are provided, and such module types are actively changeable for cleaning various objects.

In addition, recently, robot cleaners that perform self-cleaning without a user's manipulation have been used. Robot cleaners automatically clean the area to be cleaned by inhaling foreign matters such as dusts from a floor while travelling on their own.

Robot cleaners include a distance sensor for sensing distances between obstacles such as furniture, office supplies or walls located in a cleaning area, and left and right wheels for moving the robot cleaners.

A left wheel and right wheel are configured to rotate by a left motor and right motor respectively, and the robot cleaners change directions by themselves and perform indoor cleaning according to the driving of the left and right wheel motors.

However, conventional hand vacuum cleaners, stick vacuum cleaners and robot cleaners have a small capacity of a dust bin for storing collected dust, so that a user has to empty the dust bin frequently.

Further dust can be scattered while discharging a dust bin, which may negatively affect a user's health.

Still further, the suction power of the vacuum cleaner may be lowered when a residual dust in a dust bin is not removed.

Still further, an odor can occur due to a residue when a residual dust in a dust bin is not removed.

DISCLOSURE

Technical Problem

The present disclosure provides a station and a dust removal system having the same, capable of removing the hassle of emptying a dust bin every time by a user.

Further, the present disclosure provides a station and a dust removal system having them same, capable of preventing dust scattering when a dust bin is emptied.

Still further, the present disclosure provides a station and a dust removal system having the same, capable of removing the dust in a dust bin without a separate manipulation of a user and providing user convenience.

Still further, the present disclosure provides a station and a dust removal system having the same, capable of simultaneously docking a stick vacuum cleaner and a robot cleaner to selectively remove the dust in the dust bin of the stick vacuum cleaner and the robot cleaner as needed.

Still further, the present disclosure provides a station and a dust removal system having the same, capable of preventing residual dust from being remained in a dust bin and improving the suction power of a cleaner.

Still further, the present disclosure provides a station and a dust removal system having the same, capable of preventing residue dust from remaining in a dust bin and removing odors generated by the residue.

Technical Solution

The station according to one aspect of the present specification is a station to which a cleaner including a dust bin and a body cover selectively opening and closing a lower part of the dust bin is coupled, including a coupling body to which the dust bin is coupled and forms a predetermined angle with a ground: a separating unit which separates the body cover from the dust bin; a driving unit which rotates the coupling body horizontally to the ground; and a dust storage unit which is disposed under the coupling body.

In this case, when the body cover is separated from the dust bin, the dust in the dust bin may be collected by gravity into the dust storage unit.

Through this, since the dust in the dust bin can be removed without a separate manipulation of a user, user convenience can be provided.

In addition, it is possible to eliminate the hassle of the user having to empty the dust bin every time.

In addition, when the dust bin is emptied, it is possible to prevent dust from scattering.

In addition, the station may include a sensing unit which detects whether the dust bin is coupled to the coupling body.

When the dust bin is coupled to the coupling body, the driving unit may rotate the coupling body horizontally to the ground.

Through this, since the dust in the dust bin can be automatically removed without a separate manipulation, user convenience can be improved.

In addition, the station may include a rotation shaft which is connected to the driving unit: a first gear which rotates in conjunction with the rotation shaft; and a second gear which is connected to the coupling body and engaged with the first gear.

In this case, when the first gear rotates in one direction, the coupling body may rotate horizontally to the ground. When the second gear rotates in other direction, the coupling body may rotate to form the predetermined angle with the ground.

In addition, the coupling body may include a coupling surface which forms the predetermined angle with the ground and to which a lower surface of the dust bin is coupled, and an opening and closing member which is disposed under the body cover and selectively opens and closes at least a part of the coupling surface.

In this case, the station may include a rotation shaft which is connected to the driving unit: a first gear which rotates in conjunction with the rotation shaft; and a third gear which is connected to the opening and closing member and engaged with the first gear.

In addition, when the first gear rotates in one direction, the opening and closing member may rotate in a direction forming the predetermined angle with the coupling surface. When the first gear rotates in other direction, the opening and closing member may rotate in a direction horizontal to the coupling surface.

In addition, when the first gear rotates in the other direction, the opening and closing member may couple the body cover to the dust bin.

In addition, the separating unit may include a separating member which protrudes inward from an inner side surface of the station. When the coupling body rotates in a direction horizontal to the ground, a coupling lever coupling the body cover of the cleaner to the dust bin may be caught by the separating unit and separated from the dust bin.

In addition, the separating unit may be formed on the coupling body, and may include a transmission member disposed between the separating member and the coupling lever of the cleaner. One side of the transmission member may be disposed under the separating member, and other side of the transmission member may be disposed above the coupling lever of the cleaner.

In addition, a lower part of the other side of the transmission member may maintain a contacted state with an upper side of the coupling lever of the cleaner. When the coupling body rotates in a direction horizontal to the ground, an upper part of the one side of the transmission member may contact the lower part of the separating member, and the other side of the transmission member may press the coupling lever downward to separate the body cover from the dust bin.

In addition, the transmission member may include a vertical portion which connects the one side and the other side.

In addition, a lower part of the vertical portion of the transmission member may include a step portion which is disposed adjacent to the separating member than an upper part In addition, the coupling body may include a coupling surface which forms the predetermined angle with the ground and to which a lower surface of the dust bin is coupled. When the coupling body is disposed horizontally with the ground, the separating member may be disposed under the coupling surface.

In addition, the coupling body may include a coupling surface which forms the predetermined angle with the ground and to which a lower surface of the dust bin is coupled, and a guide part which is connected to the coupling surface and is formed in a shape corresponding to an outer surface of the dust bin. The separating unit may protrude inward from an inner side surface of the guide part.

The dust removal system according to one aspect of the present specification may include a cleaner including a suction unit, a suction motor which generates a suction force that sucks air along the suction unit, a dust separator which separates dust from air introduced through the suction unit, a dust bin which stores the dust separated from the dust separator, a body cover which selectively opens and closes a lower part of the dust bin, and a compression unit which moves an inner space of the dust bin and compresses the dust in the dust bin downward; and a station including a coupling body to which the dust bin is coupled and forms a predetermined angle with a ground, a separating unit which separates the body cover from the dust bin, a driving unit which rotates the coupling body horizontally to the ground, and a dust storage unit which is disposed under the coupling body.

In this case, when the body cover is separated from the dust bin, the dust in the dust bin may be collected by gravity into the dust storage unit.

Through this, since the dust in the dust bin can be removed without a separate manipulation of a user, user convenience can be provided.

In addition, it is possible to eliminate the hassle of the user having to empty the dust bin every time.

In addition, when the dust bin is emptied, it is possible to prevent dust from scattering.

In addition, the system may include a sensing unit which detects whether the dust bin is coupled to the coupling body. When the dust bin is coupled to the coupling body, the driving unit may rotate the coupling body horizontally to the ground.

In addition, the system may include a rotation shaft which is connected to the driving unit; a first gear which rotates in conjunction with the rotation shaft; and a second gear which is connected to the coupling body and engaged with the first gear.

In addition, when the first gear rotates in one direction, the coupling body may rotate horizontally to the ground. When the second gear rotates in other direction, the coupling body may rotate to form the predetermined angle with the ground.

In addition, the coupling body may include a coupling surface which forms the predetermined angle with the ground and to which a lower surface of the dust bin is coupled, an opening and closing member which is disposed under the body cover and selectively opens and closes at least a part of the coupling surface, and a third gear which is connected to the opening and closing member and engaged with the first gear. When the first gear rotates in one direction, the opening and closing member may rotate in a direction forming a predetermined angle with the coupling surface. When the first gear rotates in other direction, the opening and closing member may rotate in a direction horizontal to the coupling surface.

Advantageous Effect

The present disclosure may provide a station and a dust removal system having the same which is capable of removing the hassle of emptying a dust bin every time by a user Further, the present disclosure may provide a station and a dust removal system having them same which is capable of preventing dust scattering occurred when a dust bin is emptied.

Still further, the present disclosure may provide a station and a dust removal system having the same which is capable of removing the dust in a dust bin without a separate manipulation of a user and providing user convenience.

Still further, the present disclosure may provide a station and a dust removal system having the same which is capable of simultaneously docking a stick vacuum cleaner and a robot cleaner to selectively remove the dust in the dust bin of the stick vacuum cleaner and the robot cleaner as needed.

Still further, the present disclosure may provide a station and a dust removal system having the same which is capable of preventing residual dust from being remained in a dust bin and improving the suction power of a cleaner.

Still further, the present disclosure may provide a station and a dust removal system having the same which is capable of preventing residue dust from remaining in a dust bin and removing odors generated by the residue.

DESCRIPTION OF DRAWINGS

FIG. 1 is a perspective view of the dust removal system according to one embodiment of the present disclosure.

FIG. 2 is a cross sectional view of the dust removal system according to one embodiment of the present disclosure.

FIG. 3 is a perspective view of the station according to one embodiment of the present disclosure.

FIG. 4 is a perspective view illustrating the open state of the first door member shown in FIG. 3.

FIGS. 5 and 6 are operational diagrams illustrating that the main body of the first cleaner is coupled to the station according to one embodiment of the present disclosure.

FIG. 7 is a perspective view of the coupling body of the station according to one embodiment of the present disclosure.

FIG. 8 is a perspective view illustrating the main body of the first cleaner coupled to the coupling body of the station according to one embodiment of the present disclosure.

FIGS. 9 and 10 are operational diagrams illustrating that the main body of the first cleaner is fixed to the coupling body of the station according to one embodiment of the present disclosure.

FIGS. 11 to 13 are operational diagrams illustrating that the main body of the first cleaner coupled to the coupling body of the station is rotated according to one embodiment of the present disclosure.

FIG. 14 is a cross sectional view of the dust removal system according to one embodiment of the present disclosure.

FIGS. 15 and 16 are operational diagrams illustrating the operations of the compression unit of the first cleaner according to one embodiment of the present disclosure.

FIGS. 17 to 21 are cross sectional views of the dust removal system according to another embodiment of the present disclosure.

FIGS. 22 and 23 are operational diagrams illustrating that the continuous vinyl bag is attached to the station according to one embodiment of the present disclosure.

FIG. 24 is a perspective view of the station according to one embodiment of the present disclosure.

FIG. 25 is a perspective view of the dust removal system according to one embodiment of the present disclosure.

FIG. 26 is a perspective view of a partial configuration of the station according to one embodiment of the present disclosure.

FIG. 27 is a perspective view of the station according to one embodiment of the present disclosure.

MODE FOR INVENTION

Hereinafter, the embodiments disclosed in the present disclosure will be described in detail with reference to the accompanying drawings, but the same or similar elements are denoted by the same reference numerals regardless of reference numerals, and redundant descriptions thereof will be omitted.

However, the technical principle of the present disclosure is not limited to some embodiments to be described, but may be implemented in various different forms, and within the scope of the technical principle of the present disclosure, one or more constituent elements may be selectively combined or substituted between embodiments.

In addition, the terms (including technical and scientific terms) used in the embodiments of the present disclosure are generally understood by those of ordinary skilled in the art of the present disclosure unless explicitly defined and described. Commonly used terms such as terms defined in the dictionary may be interpreted in consideration of the meaning of the context of the related technology.

In addition, the terms used in the embodiments of the present disclosure are for illustrating the exemplary embodiments, and are not intended to limit the invention of the present invention.

In the present disclosure, the singular form may include the plural form unless specifically stated in the phrase, and when described as "at least one (or more than one) of A, (and) B and C", it may contain one or more of all possible combinations of A, B and C.

In addition, in describing the constituent elements of the embodiments of the present disclosure, the terms such as first, second, A, B, (a) and (b) may be used. These terms are only for distinguishing components from other components, and the natures, orders or sequences of the corresponding components are not limited by the terms.

And, if a component is described as being 'connected', 'coupled' or 'conjunction' to another component, the component may be directly 'connected', 'coupled' or 'conjunction' to the other component or the component may be 'connected', 'coupled' or 'conjunction' to the other component by the way of another component between the component and the other component.

In addition, when it is described as being formed or disposed in the "top (upper)" or "bottom (lower)" of each component, the meaning of "top (upper)" or "bottom (lower)" includes not only the case where the two components directly contact, but also the case where one or more other components are formed or disposed between the two components. In addition, when expressed as "top (upper)" or "bottom (lower)", the meaning of not only an upward direction but also downward direction based on one component may be included.

On the other hand, terms of the disclosure can be replaced with terms such as document, specification or description.

FIG. 1 is a perspective view of the dust removal system according to one embodiment of the present disclosure. FIG. 2 is a cross sectional view of the dust removal system according to one embodiment of the present disclosure. FIG. 3 is a perspective view of the station according to one embodiment of the present disclosure. FIG. 4 is a perspective view illustrating the open state of the first door member shown in FIG. 3. FIGS. 5 and 6 are operational diagrams illustrating that the main body of the first cleaner is coupled to the station according to one embodiment of the present disclosure. FIG. 7 is a perspective view of the coupling body of the station according to one embodiment of the present disclosure. FIG. 8 is a perspective view illustrating the main body of the first cleaner coupled to the coupling body of the station according to one embodiment of the present disclosure. FIGS. 9 and 10 are operational diagrams illustrating that the main body of the first cleaner is fixed to the coupling body of the station according to one embodiment of the present disclosure. FIGS. 11 to 13 are operational diagrams illustrating that the main body of the first cleaner coupled to the coupling body of the station is rotated according to one embodiment of the present disclosure. FIG. 14 is a cross sectional view of the dust removal system according to one embodiment of the present disclosure. FIGS. 15 and 16 are operational diagrams illustrating the operations of the compression unit of the first cleaner according to one embodiment of the present disclosure. FIGS. 17 to 21 are cross sectional views of the dust removal system according to another embodiment of the present disclosure. FIGS. 22 and 23 are operational diagrams illustrating that the continuous vinyl bag is attached to the station according to one embodiment of the present disclosure. FIG. 24 is a perspective view of the station according to one embodiment of the present disclosure. FIG. 25 is a perspective view of the dust removal system according to one embodiment of the present disclosure. FIG. 26 is a perspective view of a partial configuration of the station according to one embodiment of the present disclosure. FIG. 27 is a perspective view of the station according to one embodiment of the present disclosure.

Reference to FIGS. 1 to 27, the dust removal system 10 according to one embodiment of the present disclosure may include a station 100, a first cleaner 200, and a second cleaner 300. However, in one embodiment of the present disclosure, some of these components may be excluded or additional components may be included, The dust removal system 10 may include a station 100. The first cleaner 200 and the second cleaner 300 may be disposed to the station 100. The first cleaner 200 may be coupled on the upper part of the station 100. Particularly, on the upper part of the station 100, the main body of the first cleaner 200 may be coupled. The second cleaner 300 may be coupled under the lower part of the station. The station 100 may remove the dust of the dust bin 215 of the first cleaner 200. The station 100 may remove the dust of the dust bin (unshown) of the second cleaner 300.

The station 100 may include a housing 110. The housing 110 can form the exterior appearance of the station 100. A coupling body 120 on which the first cleaner 200 is coupled may be disposed on the upper part of the housing 110. The second cleaner 300 may be coupled under the lower part of the housing 110. A dust storage unit 130, a first flow path 140, a second flow path 150, a valve 160 and a suction member 170 (e.g., fan) may be disposed inside the housing 110. In one embodiment of the present disclosure, the housing 110 is descried as being formed in a hexahedron shape as an example, but the shape of the housing 110 is not limited thereto, and the shape of the housing 110 may be variously changed.

The housing 110 may include a first door member 112. The first door member 112 may be disposed on the upper surface of the housing 110. The first door member 112 may selectively expose to an outside the coupling body 120 disposed on the upper part of the housing 100. The first door member 112 may be opened when a user approaches the station 100, and the first door member 112 may be closed when the first cleaner 200 coupled on the station 100 is separated from the station 100. Accordingly, it is possible to prevent foreign matters such as dust from entering inside of the station 100.

The housing 110 may include a first sensing unit 113. The first sensing unit 113 may be disposed on the housing 110. The first sensing unit 113 may detect whether a user approaches the station 100. The first sensing unit 113 may include a non-contact sensor. As one exemplary, the first sensing unit 113 may include an infrared sensing unit (IR sensor). The first sensing unit 113 may include a contact sensor. As one exemplary, the first sensing unit 113 may include a micro switch. In one embodiment of the present disclosure, the first sensing unit 113 is disposed on the upper surface of the housing as one example. However, the position of the first sensing unit 113 may be variously changed as long as it can detect whether a user approaches or not.

The station 100 may include the coupling body 120. The coupling body 120 may be disposed on the upper part of the station 100. The coupling body 120 may be disposed on the upper part of the housing 110. The coupling body 120 may be selectively opened and closed by the first door member 112. The first cleaner 200 may be coupled on the coupling body 120. The main body 210 of the first cleaner 200 may be coupled on the coupling body 120.

The coupling body 120 may form a predetermined angle with a ground. Through this, when a user couples the main body 210 of the first cleaner 200 to the station 100, the main body 210 of the first cleaner 200 slides and couples to the coupling body 120 in a correct position.

In one embodiment of the present specification, the predetermined angle of the coupling body 120 formed with the ground may be between 20 degrees and 30 degrees.

If the predetermined angle of the coupling body 120 formed with the ground is greater than 30 degrees, the inclination of the dust bin 215 is sever and there is a risk that the dust in the dust bin 215 remains due to gravity.

In addition, if the predetermined angle of the coupling body 120 formed with the ground is less than 20 degrees, it may not reach the static friction force between the lower surface of the dust bin 215 and the upper surface of the coupling body 120 and the dust bin 215 may not slide the coupling body 120.

In one embodiment of the present specification, the lower surface of the dust bin 215 may be formed of a polycarbonate (PM) plastic material, and the upper surface of the coupling body 120 may be formed of a polyoxymethylene (POM) plastic material. In this case, the coefficient of static friction of the polycarbonate plastic material with respect to the polyoxymethylene plastic material may be about 0.22. In addition, when a correction of 1.5 times is applied due to a foreign matter between the lower surface of the dust bin 215 and the upper surface of the coupling body 120, tan θ may be about 0.33. That is, if the predetermined angle of the coupling body 120 formed with the ground is less than 20 degrees, the dust bin 215 may not slide the coupling body 120 because it does not reach the static friction force between the lower surface of the dust bin 215 and the upper surface of the coupling body 120.

Preferably, the predetermined angle of the coupling body 120 formed with the ground may be between 23 degrees and 30 degrees. Considering the weight of the main body 210 of the first cleaner 200 and the average female body condition, if the predetermined angle of the coupling body 120 formed with the ground is less than 23 degrees, the user's wrist may be strained.

The coupling body 120 may include a coupling surface 121. The coupling surface 121 may be disposed on the upper surface of the housing 110. The first cleaner 200 may be coupled on the coupling surface 121. Specifically, the main body 210 of the first cleaner 200 may be coupled on the coupling surface 121. For example, the dust bin 215 of the first cleaner 200 may be disposed on the coupling surface 121. The coupling surface 121 may form a predetermined angle with a ground. For example, an angle formed by the coupling surface 121 with the ground may be an acute angle. Accordingly, it is convenient that the main body 210 of the first cleaner 200 is coupled on the coupling surface 121. Here, the coupling between the coupling surface 121 and the main body 210 of the first cleaner 200 may mean a physical coupling in which the first cleaner 200 and the station 100 are coupled and fixed.

The coupling body 120 may include a first guide part 122. The first guide part 122 may be disposed on the upper part of the housing 110. The first guide part 122 may be connected to the upper surface of the housing 110. The first guide part 122 may be connected to the coupling surface 121. The first guide part 122 may form a predetermined angle with the ground. For example, an angle formed by the first guide part 122 with the ground may be an obtuse angle. The first guide part 122 may be formed in a shape corresponding to the outer surface of the dust bin 215. The outer surface of the dust bin 215 may be coupled on the first guide part 122. Accordingly, there is convenience that the main body 210 of the first cleaner 200 is coupled on the coupling surface 121.

The coupling body 120 may include a second guide part 123. The second guide part 123 may be disposed on the coupling surface 121. The second guide part 123 may protrude upward from the coupling surface 121. The second guide part 123 may include first and second guide members spaced apart from each other. The distance between the first guide member and the second guide member may correspond to the width of the main body 210 of the first cleaner 200. Specifically, the distance between the first guide member and the second guide member may correspond to the width of the battery housing 220 of the first cleaner 200. Accordingly, there is convenience that the main body 210 of the first cleaner 200 is coupled on the coupling surface 121.

The coupling body 120 may include a fixing part 124. The fixing part 124 may be disposed on the coupling surface 121. The fixing part 124 may be disposed on the second guide part 123. The fixing part 124 may fix the first cleaner 200 coupled on the coupling surface 121. Specifically, the fixing part 124 may fix the main body 210 of the first cleaner 200 coupled on the coupling surface 121. The fixing part 124 may include a fixing member 129 fixing the main body 210 of the first cleaner 200 and a fifth driving unit 1291 for driving the fixing member 129. In an embodiment of the present invention, the fifth driving unit 1291 is described as an example of moving the fixing member 129 up and down, but as long as the main body 210 of the first cleaner 200 is fixed to the coupling body 120, the shape of the fixing member 129 and the type of the fifth driving unit 1291 may be variously changed.

The fixing member 129 may be disposed on both sides of the bottom surface of the main body 210 of the first cleaner 200 coupled to the coupling body 120. The width of the fixing member 129 may correspond to the width of the main body 210 of the first cleaner 200 or may be smaller than the width of the main body 210 of the first cleaner 200. The fixing member 129 may be disposed on a second guide part 123. Specifically, referring to FIGS. 4, 7, 9 and 10, the fixing member 129 may be disposed on a surface of the first and second guide members facing each other. Through this, the main body 210 of the first cleaner 200 guided by the second guide part 123 may be fixed in a correct position.

In an embodiment of the present invention, the fifth driving unit 1291 is described as an example of moving the fixing member 129 up and down, but as long as the main body 210 of the first cleaner 200 is fixed to the coupling body 120, the shape of the fixing member 129 and the type of the fifth driving unit 1291 may be variously changed.

The coupling body 120 may include a second sensing unit 125. The second sensing unit 125 may be disposed in the housing 110. The second sensing unit 125 may detect whether the first cleaner 200 is coupled on the coupling body 120. The second sensing unit 125 may face the main body 210 of the first cleaner 200. The second sensing unit 125 may include a non-contact sensor. For example, the second sensing unit 125 may include an infrared sensor unit (IR sensor). The second sensing unit 125 may include a contact sensor. For example, the second sensing unit 125 may include a micro switch.

The coupling body 120 may include an opening and closing member 126. The opening and closing member 126 may be disposed in the housing 110. The opening and closing member 126 may be disposed on the coupling surface 121. The opening and closing member 126 may selectively open and close at least a part of the coupling surface 121 to communicate the upper part of the coupling body 120 with a first flow path 140 and/or the dust storage unit 130. The opening and closing member 126 may be opened when the body cover 240 of the first cleaner 200 is opened. The opening and closing member 126 may rotate downward based on a second axis 1261. The opening and closing member 126 may be closed by a connection member 191 and a third driving unit 190. For example, the opening and closing member 126 may be rotated to one side by the third driving unit 190. The opening and closing member 126 may close the body cover 240 of the first cleaner 200 by closing the opening and closing member 126.

Unlike this, the opening and closing member 126 may be opened and closed based on a second rotation shaft 184 by a first driving unit 179. Through this, the dust bin 215 of the first cleaner 200 and the first flow path 140 may be coupled in a flow path so that a fluid flows.

The coupling body 120 may include a first driving unit 179. The first driving unit 179 may include a first rotation shaft 181 and a second rotation shaft 184. Furthermore, the driving unit 120 may also include a first gear 182, a second gear 183 and a third gear 185. The first driving unit 179 may be disposed in the housing 110. The first driving unit 179 may rotate the coupling surface 121. When the dust bin 215 is coupled on the coupling surface 121, the first driving unit 179 may rotate the coupling surface 121 horizontally with a ground. Accordingly, it is possible to improve the collecting efficiency that the dust inside the dust bin 215 is collected by its own weight into the dust storage unit 130.

When the dust bin 215 is coupled to the coupling body 120, the first driving unit 179 may rotate the coupling body 120 horizontally with the ground. Specifically, when the second sensing unit 125 detects that the coupling body 120 is coupled to the dust bin 215, the first driving unit 179 may rotate the coupling body 120 horizontally with the ground.

The station 100 may include the first rotation shaft 181 of the first driving unit 179. The first rotation shaft 181 may be interlocked with a first gear 182. The first rotation shaft 181 may rotate the first gear 182 in one direction or in other direction opposite to the one direction.

The station 100 may include the first gear 182. The first gear 182 may be connected to the first rotation shaft 181. The first gear 182 may rotate in conjunction with the first rotation shaft 181. The first gear 182 may be rotated in one direction or the other direction by the first driving unit 179. The first gear 182 may be engaged with a second gear 183.

Referring to FIGS. 11 to 13, when the first gear 182 rotates in one direction, the first gear 182 may rotate the second gear 183 in one direction. When the first gear 182 rotates in the other direction, the first gear 182 may rotate the second gear 183 in the other direction. Through this, the first gear 182 may rotate the coupling body 120 in one direction or the other direction.

The station 100 may include the second gear 183. The second gear 183 may be connected to the coupling body 120. Specifically, the second gear 183 may be connected to the coupling surface 121. The second gear 183 may be engaged with the first gear 182.

Referring to FIGS. 11 to 13, when the first gear 182 is rotated in one direction, the second gear 183 may be rotated in one direction by the first gear 182 to rotate the coupling body 120 in one direction. Through this, the coupling body 120 may be disposed horizontally with the ground. That is, as shown in FIG. 13, since the dust bin 215 is disposed horizontally with the ground, the inside of the dust bin 215 can be exposed to the user from the top of the station 100, it is easy for the user to visually identify the presence or absence of the dust in the dust bin 215.

When the first gear 182 is rotated in the other direction, the second gear 183 may be rotated in the other direction by the first gear 182 to rotate the coupling body 120 in the other direction. Through this, the coupling body 120 may be disposed to form a predetermined angle with the ground.

The station 100 may include the second rotation shaft 184. The second rotation shaft 184 may be connected to the opening and closing member 126. The second rotation shaft 184 may be connected to a third gear 185.

The station 100 may include the third gear 185. The third gear 185 may be connected to the second rotation shaft 184. The third gear 185 may be connected to the opening and closing member 126. The third gear 185 may be connected to the opening and closing member 126 through the second rotation shaft 184. Alternatively, the third gear 185 may be directly connected to the opening and closing member 126. The third gear 185 may be engaged with the first gear 182.

Referring to FIGS. 11 to 13, when the first gear 182 is rotated in one direction, the third gear 185 may rotate in the other direction by the first gear 182 to rotate the opening and closing member 126 in the other direction. Through this, the opening and closing member 126 may rotate to form a predetermined angle with the coupling surface 121. When the first gear 182 rotates in the other direction, the third gear 185 may rotate in one direction by the first gear 182 to rotate the opening and closing member 126 in one direction. Through this, the opening and closing member 126 may be rotated in a direction horizontal to the coupling surface 121. When the opening and closing member 126 rotates in a direction horizontal to the coupling surface 121, the opening and closing member 126 may couple the body cover 240 to the dust bin 215.

The coupling body 120 may include a third guide part 127. The third guide part 127 may be disposed on an upper part of the housing 110. The third guide part 127 may be connected to the second guide part 122. A suction unit 214 may be coupled to the third guide part 127. The shape of the third guide part 127 may be formed in a shape corresponding to the shape of the suction unit 214. Through this, convenience in which the main body 210 of the first cleaner 200 is coupled to the coupling surface 121 may be provided.

The station 100 may include a separating unit 128. When the coupling surface 121 forms a predetermined angle with a ground, the separating unit 128 may be disposed on an upper part of the coupling surface 121. The separating unit 128 may be disposed adjacent to the second guide part 122. The separating unit 128 may be disposed on the second guide part 122. When the main body 210 of the first cleaner 200 is coupled to the coupling body 120, the separating unit 128 may separate the body cover 240 from the dust bin 215.

The separating unit 128 may include a separating member 1283. The separating member 1283 may be disposed on the inner side surface of the station 100. The separating member 1283 may protrude inward from the inner side surface of the station 100. The separating member 1283 may be disposed on the inner side surface of the coupling body 120. The separating member 1283 may protrude inward from the inner side surface of the coupling body 120. The separating member 1283 may be disposed on the second guide part 122. The separating member 1283 may protrude inward from the second guide part 122.

FIGS. 11 to 13 illustrate that a transmission member 1284 is included as an example, but unlike this, the transmission member 1284 may not be disposed between the second guide part 122 and the coupling lever 241. In this case, when the coupling body 120 rotates in a direction horizontal to the ground, the coupling lever 241 of the first cleaner 200 may be directly caught by the separating member 1283 and separated from the dust bin 215. Through this, the body cover 240 is separated from the dust bin 215 so that the dust in the dust bin 215 may be moved to the dust storage unit 130.

The separating unit 128 may include the transmission member 1284. The transmission member 1284 may be formed on the coupling body 120. The transmission member 1284 may be formed on the coupling surface 121. The transmission member 1284 may rotate in one direction or the other direction like the coupling surface 121. The transmission member 1284 may be disposed between the separating member 1283 and the coupling lever 241 of the first cleaner 200. Specifically, one side of the transmission member 1284 may be disposed under the separating member 1283, and the other side of the transmission member 1284 may be disposed above the coupling lever 241. In this case, the other side of the transmission member 1284 may maintain a contacted state with the coupling lever 241 or may be maintained in a spaced state.

When the coupling body 120 rotates in a direction horizontal to the ground, the upper part or upper surface of one side of the transmission member 1284 may contact the lower part or lower surface of the separating member 1283. In this case, the other side of the transmission member 1284 may press the coupling lever 241 downward to separate the body cover 240 from the dust bin 215.

The transmission member 1284 may include a vertical portion connecting one side and the other side. When the coupling body 120 is disposed horizontally with the ground, the vertical portion of the transmission member 1284 may extend in the vertical direction as shown in FIG. 12 Through this, since the separating member 1283 is disposed below the coupling surface 121 of the coupling body 120, space efficiency inside the station 100 can be improved.

In addition, the vertical portion of the transmission member 1284 may include a step portion in which a lower part is disposed adjacent to the separating member 1283 than an upper part. Specifically, referring to FIG. 12, the lower region of the vertical portion of the transmission member 1284 may be disposed adjacent to the separating member 1283 than the upper region of the vertical portion of the transmission member 1284. Through this, space efficiency inside the station 100 can be improved.

Since the body cover 240 is separated from the dust bin 125 through the separating unit 128 in a state in which the bottom surface of the dust bin 215 is horizontal to the ground, the efficiency of collecting the inside of the dust bin 215 into the dust storage unit 130 by its own weight can be improved.

In the exemplary embodiment of the present specification, an example is described that the separating member 1283 is maintained in a fixed state. Unlike this, the separating member 1283 may be moved vertically through a second driving unit.

The station 100 may include a dust storage unit 130. The dust storage unit 130 may be disposed in the housing 110. The dust storage unit 130 may be disposed under the coupling body 120. Accordingly, when the body cover 240 is separated from the dust bin 215, the dust in the dust bin 215 may be collected by the dust storage unit 130 by gravity.

The station 100 may include a first flow path 140. The first flow path 140 may connect the dust bin 215 of the first cleaner 200 and the dust storage unit 130. The first flow path 140 may refer to a space between the dust bin 215 of the first cleaner 200 and the dust storage unit 130. Unlike FIG. 2, the first flow path 140 may mean a straight area extending vertically. The dust in the dust bin 215 of the first cleaner 200 may move to the dust storage unit 130 through the first flow path 140.

The station 100 may include a second flow path 150. The second flow path 150 may connect the second cleaner 300 and the dust storage unit 130. The dust in the second cleaner 300 may move to the dust storage unit 130 through the second flow path 150.

The station 100 may include a valve 160. The valve 160 may be disposed between the dust storage unit 130, the first flow path 140 and the second flow path 150. The valve 160 may selectively open and close the first flow path 140 and the second flow path 150 connected to the dust storage unit 130. Accordingly, it is possible to prevent the decrease in suction power caused by opening the plurality of flow paths 140 and 150.

For example, when only the first cleaner 200 is coupled on the station 100, the valve 160 may connect the first flow path 140 and the dust storage unit 130, and separate the second flow path 150 and the dust storage unit 130.

As another example, when only the second first cleaner 300 is coupled on the station 100, the valve 160 may separate the connection between the first flow path 140 and the dust storage unit 130, and connect the second flow path 150 and the dust storage unit 130.

As another example, when both the first cleaner 200 and the second cleaner 300 are coupled on the station 100, the valve 160 may connect the first flow path 140 and the dust storage unit 130 and separate the second flow path 150 and the dust storage unit 130, thereby removing the dust in the dust bin 215 from the first cleaner 200. Thereafter, the valve 160 may separate the connection between the first flow path 140 and the dust storage unit 130 and connect the second flow path 150 and the dust storage unit 130, thereby removing the dust from the second cleaner 300. Accordingly, the user convenience of the manually operated first cleaner 200 can be increased.

The station 100 may include a suction member 170. The a suction member 170 may be disposed in the dust storage unit 130. Alternatively, the suction member 170 may be disposed outside the dust storage unit 130 and may be connected to the dust storage unit 130. The suction member 170 may generate suction power in the first flow path 140 and the second flow path 150. Accordingly, the suction member 170 may provide a suction power capable of sucking the dust in the dust bin 215 of the first cleaner 200 and the dust in the second cleaner 300.

The station 100 may include a charging unit. The charging unit may include a first charger disposed on the coupling body 120. The first charger may be electrically connected to the first cleaner 200 coupling on the coupling body 120. The first charger may supply power to the battery of the first cleaner 200 coupled on the coupling body 120. In addition, the charging unit may include a second charger disposed on the lower region of the housing 110. The second charger may be electrically connected to the second cleaner 300 coupled on the lower area of the housing 110. The second charger may supply power to the battery of the second cleaner 300 coupled on the lower area of the housing 110.

The station 100 may include a side door. The side door may be disposed on the housing 110. The side door may selectively expose the dust storage unit 130 to an outside. Thus, since a user can use the dust storage unit 130 as a trash bin, user convenience can be improved. In addition, it allows a user to easily remove the dust storage unit 130 from the station 100.

The dust removal system 10 may include a first cleaner 200. The first cleaner 200 may include a cleaner manually operated by a user. For example, the first cleaner 200 may be a hand vacuum cleaner or a stick vacuum cleaner.

The first cleaner 200 may be coupled over the station 100. The first cleaner 200 may be supported by the station 100. The first cleaner 200 may be coupled on the station 100. The first cleaner 200 may be coupled on the upper part of the housing 110. Specifically, the main body 210 of the first cleaner 200 may be coupled on the coupling body 120. The dust in the dust bin 215 of the first cleaner 200 may be collected by gravity into the dust storage unit 130 of the station 100. Accordingly, since the dust in the dust bin can be removed without a separate manipulation of the user, user convenience can be provided. In addition, it is possible to eliminate the hassle of the user having to empty the dust bin every time. In addition, when the dust bin is emptied, it is possible to prevent the dust from scattering.

The first cleaner 200 may include a main body 210. The main body 210 may include a suction motor 205. The main body 210 may be connected to an extension tube 280. The main body 210 may be connected to a cleaning module 290 through the extension tube 280. The main body 210 may generate a suction power through the suction motor 205 and may provide a suction power to the cleaning module 290 through the extension tube 280. External dust may flow into the main body 210 through the cleaning module 290 and the extension tube 280.

A hinge 282 may be disposed on the extension tube 280. Specifically, at least a portion of the extension tube 280 may be rotated based on the hinge 282. Accordingly, when the main body 210 of the first cleaner 200 is coupled to the station 100, the extension tube 280 may support the main body 210.

The main body 210 may include a suction unit 214. The suction unit 214 may protrude outward from the main body 210. The suction unit 214 may be formed in a cylindrical shape with an open inside. The suction unit 214 may communicate with the extension tube 280. The suction unit 214 may suck the air having dust. The suction unit 214 may be coupled on the coupling body 120. Specifically, the suction unit 214 may be coupled on the third guide part 217 of the coupling body 120.

The main body 210 may include a dust separator 211. The dust separator 211 may communicate with the suction unit 214. The dust separator 211 may separate the dust sucked into the interior through the suction unit 214. The dust separator 211 may communicate with the dust bin 215.

For example, the dust separator 211 may separate dust by cyclone flow. The cyclone unit generating the cyclone flow may be disposed in at least one inside of the dust separator 211 and the dust bin 215. The cyclone unit may communicate with the suction unit 214. The air and dust sucked through the suction unit 214 spirally flow along the inner circumferential surface of the cyclone unit. The axis of the cyclone flow of the cyclone unit may extend in the vertical direction.

The main body 210 may include a dust bin 215. The dust bin 215 may communicate with the dust separator 211. The dust bin 215 may store the dust separated by the dust separator 211.

The main body 210 may include a discharge cover 209 having an air discharge port 212 through which air is discharged from the suction motor 205. A HEPA filter for filtering air may be accommodated in the discharge cover 209. A flow guide may be disposed on the discharge cover 209. The flow guide may guide the flow of air discharged through the air discharge outlet 212.

The first cleaner 200 may include a handle 216. The handle 216 can be held by a user. The handle 216 may be disposed behind the suction motor 205. That is, the shaft of the suction motor 205 may be disposed between the suction unit 214 and the handle 216. In the exemplary embodiment of the present specification, a front refers to a direction in which the suction unit 214 is disposed relative to the suction motor 205, and a rear may refer to a direction in which the handle 216 is disposed. The upper surface of the handle 216 may form a partial appearance of the upper surface of the first cleaner 200. Thus, when a user grips the handle 216, it is possible to prevent one component of the first cleaner 200 from contacting the user's arm.

The first cleaner 200 may include an extension part 218. The extension part 218 may extend from the handle 216 toward the suction motor 205. At least a portion of the extension part 218 may extend in a horizontal direction.

The first cleaner 200 may include a movement limiting part 217. The movement limiting part 217 may be disposed on the handle 216. The movement limiting part 217 may be disposed on one side of the handle 216 facing the main body 210. The movement limiting part 217 may serve to prevent the user's hand from moving in the longitudinal direction or the vertical direction of the handle 216. The movement limiting part 217 may be spaced apart from the extension part 218. That is, while holding the handle 216, some fingers of the user may be located above the movement limiting part 217, and the other fingers may be located below the movement limiting part 217. For example, the movement limiting part 217 may be positioned between the index finger and the middle finger.

The first cleaner 200 may include a first control unit 219. The first control unit 219 may be disposed on the handle 216. The first control unit 219 may be disposed on an inclined surface formed in an upper area of the handle 216. The user may input an operation or stop command of the first cleaner 200 through the first control unit 219.

The first cleaner 200 may include a battery housing 220. The battery 230 may be accommodated in the battery housing 220. The battery housing 220 may be disposed under the handle 216. The battery housing 220 may have a hexahedral shape with an open lower part. The rear surface of the battery housing 220 may be connected to the handle 216.

The battery housing 220 may include a heat exhaustion hole for discharging the heat generated from the battery 230 to an outside. Since heat is discharged to the outside of the battery housing 220 by the heat exhaustion hole, the life of the battery 230 may be extended through smooth cooling of the battery 230. The battery housing 220 may include a receiving part that is opened downward. The battery 230 may be received in the receiving part of the battery housing 220.

The first cleaner 200 may include an extension tube 280. The extension tube 280 may be in communication with the cleaning module 290. The extension tube 280 may be in communication with the main body 210. The extension tube 280 may be in communication with the suction unit 214 of the main body 210. The extension tube may be formed in a long cylindrical shape.

The first cleaner 200 may include a cleaning module 290. The cleaning module 290 may communicate with the extension tube 280. External air may flow into the main body 210 of the first cleaner 200 through the cleaning module 290 and the extension tube 280 due to the suction power generated by the main body 210 of the first cleaner 200.

The first cleaner 200 may include a battery 230. The battery 230 may be detachably coupled to the first cleaner 200. The battery 230 may be detachably coupled to the battery housing 220. For example, the battery 230 may be inserted into the battery housing 220 from below the battery housing 220. The battery 230 may supply power to the suction motor 205 of the first cleaner 200.

The battery 230 may be disposed under the handle 216. The battery 230 may be disposed behind the dust bin 215. That is, the suction motor 205 and the battery 230 may be arranged so as not to overlap in the vertical direction, and the arrangement height may be different. Based on the handle 216, a suction motor 205 having a heavy weight is disposed in front of the handle 216, and a battery 230 having a heavy weight is disposed below the handle 216, so that the overall weight can be evenly distributed through the first cleaner 200. Thus, when a user holds the handle 216 and cleans, it is possible to prevent the user's wrist from being strained.

When the battery 230 is coupled to the battery housing 220, the lower surface of the battery 230 may be exposed to an outside. When the first cleaner 200 is placed on a floor, the battery 230 may be placed on the floor, so that the battery 230 can be directly separated from the battery housing 220. In addition, since the lower surface of the battery 230 is exposed to the outside and directly contacts the external air of the battery 230, the cooling performance of the battery 230 may be improved.

The main body 210 may include a body cover 240. The body cover 240 may be disposed under the lower part of the dust bin 215. The body cover 240 may selectively open and close the lower part of the dust bin 215 that is opened downward. The body cover 240 may rotate downward based on a hinge part 242. The hinge part 242 may be disposed adjacent to the battery housing 220. The body cover 240 may be coupled to the dust bin 215 through the coupling lever 241. The coupling lever 241 may be coupled to the front of the main body 210. Specifically, the coupling lever 241 may be coupled to the front side outer surface of the dust bin 215.

The main body 210 may include a compression unit 250. The compression unit 250 may be disposed in the dust bin 215. The compression unit 250 may move the inner space of the dust bin 215. Specifically, the compression unit 250 may move up and down in the dust bin 215. Thus, the compression unit 250 may compress the dust in the dust bin 215 downward. In addition, when the body cover 240 is separated from the dust bin 215 and the lower part of the dust bin 215 is opened, the compression unit 250 moves from the upper part to the lower part of the dust bin 215 to remove the foreign matter such as the residual dust in the dust bin 215. Thus, the suction power of the cleaner may be improved by preventing residual dust from remaining in the dust bin. In addition, it is possible to remove odors generated by the residue by preventing the residual dust from remaining in the dust bin.

The main body 210 may include a second control unit 251. The second control unit 251 may protrude outside the body 210. The second control unit 251 may be disposed outside the dust bin 215 or the dust separator 211. The second control unit 251 may be disposed to move up and down outside the dust bin 215 or the dust separator 211. The second control unit 251 may be connected to the compression unit 250. When the second control unit 251 moves downward by the user's external force, the compression unit 250 may also move downward. Accordingly, user convenience can be provided. The compression unit 250 and the second control unit 251 may be returned to their original positions by an elastic member. Specifically, when the external force applied to the second control unit 251 is removed, the elastic member may move the second control unit 251 and the compression unit 250 upward.

The dust removal system 10 may include a second cleaner 300. The second cleaner 300 may include a robot cleaner. The second cleaner 300 may automatically clean the area to be cleaned by inhaling foreign matters such as dust from a floor while driving the area to be cleaned by itself. The second cleaner 300 may include a distance sensor that senses a distance to an obstacle such as furniture, office supplies, or walls installed in a cleaning area, and a left wheel and a right wheel for moving the robot cleaner.

The second cleaner 300 may be coupled to the station so that the dust storage space in the second cleaner 300 may be connected to the second flow path 150 of the station 100 in a flow path.

The dust in the second cleaner 300 may be collected into the dust storage unit 130 through the second flow path 150.

Referring to FIGS. 3 and 4, when a user approaches the station 100, the first door member 112 may move upward, and the coupling body 120 may be exposed upward. In this case, whether the user approaches the station 100 may be detected through the first sensing unit 113. Thus, since the user does not need to open and close the first door member 112 separately, user convenience can be provided.

Referring to FIGS. 5 and 6, when a user mounts the first cleaner 200 on the coupling body 120 of the station 100, the main body 210 of the first cleaner 200 may be stably disposed on the coupling body 120 by the slope of the coupling surface 121 and the first to third guide parts 122, 123 and 127. Thus, it is convenient that the main body 210 of the first cleaner 200 is coupled on the coupling surface 121.

Referring to FIGS. 8 and 10, when the main body 210 of the first cleaner 200 is disposed on the coupling body 120, the fixing part 124 can make the main body 210 of the first cleaner 200 to move. Specifically, when the second sensing unit 125 detects that the main body 210 of the first cleaner 200 is coupled on the coupling body 120 of the station 100, the fifth driving unit 1291 moves a fixing member 129 upward and fixes the main body 210 of the first cleaner 200.

Accordingly, the amount of vibration and impact generated when the body cover 240 of the main body 210 of the fixed first cleaner 200 is separated from the dust bin 215 is increased, and the efficiency of moving the dust stored in the dust bin 215 to the dust storage unit 130 of the station 100 may be improved. That is, the suction power of the cleaner may be improved by preventing residual dust from remaining in the dust bin. In addition, it is possible to remove odors generated by the residue by preventing residual dust from remaining in the dust bin.

In the exemplary embodiment of the present specification, the fifth driving unit 1291 is described as an example of a solenoid actuator, but is not limited thereto and may be variously changed to an electromagnetic force actuator.

Referring to FIGS. 11 to 13, when the main body 210 of the first cleaner 200 is fixed to the coupling body 120, the second driving unit 1111 moves the separating member 111 downward so that the body cover 240 can be separated from the dust bin 215. When the body cover 240 is separated from the dust bin 215, the dust in the dust bin 215 may be collected by the dust storage unit 130 by gravity and load. At this time, the opening and closing member 126 rotates downward by the weight of the dust bin 215 separated from the dust bin 215, so that the lower part of the dust bin 215 and the dust storage unit 130 may communicate with each other. Alternatively, in the exemplary embodiment of the present specification, it may be implemented except for the opening and closing member 126.

Accordingly, since the dust in the dust bin can be removed without a separate manipulation of a user, user convenience can be provided. In addition, it is possible to eliminate the hassle of the user having to empty the dust bin every time. In addition, when the dust bin is emptied, it is possible to prevent the dust from scattering.

Referring to FIGS. 12 and 13, when the main body 210 of the first cleaner 200 is fixed to the coupling body 120, the first driving unit 179 may rotate the coupling surface 121. In this case, since the coupling surface 121 is positioned horizontally with a ground, it is possible to improve the efficiency in which the dust inside the dust bin 215 is collected by its own weight into the dust storage unit 130.

Even when the coupling surface 121 rotates, the body cover 240 may be separated from the dust bin 215 by the second driving unit 1111 as shown in FIG. 11. In contrast, when a separate protrusion is formed on the inner surface of the coupling body and the coupling surface 121 is horizontal with the ground, the protrusion formed on the inner surface of the coupling body contacts the coupling lever 241 to separate the body cover 240 from the dust bin 215.

Hereinafter, in FIGS. 14 to 21, a state in which the coupling body 120 is in a predetermined state with the ground will be described as an example, but it can be understood that the coupling body 120 may be in a state horizontal with the ground as shown in FIG. 13.

Referring to FIG. 14, the dust storage unit 130 may include a continuous vinyl bag 132. The continuous vinyl bag 132 is fixed to the housing 110 and can be spread down by the load of the dust falling from the dust bin 215.

Referring to FIGS. 22 and 23, the station 100 may include joint parts 134, 135. The joint parts 134,135 may be disposed on the housing 110. The joint parts 134,135 may be disposed on the upper area of the dust storage unit 130. The joint parts 134,135 may cut and joint the upper area of the continuous vinyl bag 132 in which dust is collected. Specifically, the joint parts 134,135 may collect the continuous vinyl bag 132 into a central region and bonds the upper region of the continuous vinyl bag 132 with heat-wire. The joint parts 134, 135 may include a first joint member 134 and a second joint member 135. The first joint member 134 may move in a first direction through a sixth driving unit, and the second joint member 135 may move in a second direction perpendicular to the first direction through a seventh driving unit.

Referring to FIGS. 15 and 16, when the control unit 251 moves downward, the compression unit 250 may move downward to move the dust in the dust bin 215 downward. In one embodiment of the present specification, the body cover 240 is separated from the dust bin 215 and the dust in the dust bin 215 is primarily collected by the dust separator 130 by gravity, and then, the residual dust in the dust bin 215 may be secondly collected by the dust separator 211 by the compression unit 250. In contrast, the compression unit 250 compresses the dust in the dust bin 215 downward while the body cover 240 is coupled to the dust bin 215, and the body cover 240 is separated from the dust bin 215 and the dust in the dust bin 215 may be collected by the dust separator 130.

Referring to FIG. 17, the station 100 according to another embodiment of the present specification may include a first flowing part 172. The first flowing part 172 may flow air to the suction unit 214 of the first cleaner 200. The air flowing to the suction unit 214 of the first cleaner 200 may move the remaining dust in the dust bin 215 downward and collect it into the dust storage unit 130. Accordingly, the suction power of the first cleaner 200 may be improved by preventing the residual dust from remaining in the dust bin 215. In addition, by preventing residual dust from remaining in the dust bin 215, the odors generated by the residue may be removed.

Referring to FIG. 18, the station 100 according to another embodiment of the present specification may include a sealing member 2142 that seals the suction unit 214 of the main body 210 of the first cleaner 200 coupled on the coupling body 120, and a suction member 174 (e.g., fan) that sucks the dust from the dust bin 215 and collects the dust into the dust storage unit 130. Accordingly, the suction power of the first cleaner 200 may be improved by preventing the residual dust from remaining in the dust bin 215. In addition, by preventing the residual dust from remaining in the dust bin 215, the odors generated by the residue may be removed.

Referring to FIG. 19, the station 100 according to another embodiment of the present specification may include a sealing member 2142 that seals the suction unit 214 of the main body 210 of the first cleaner 200 coupled on the coupling body 120, and a second flowing part 176 for flowing air into the dust bin 215. The second flowing part 176 may be understood to be the same as the first flowing part 172. The second flowing part 176 may flow the air into the dust bin 215 instead of the suction unit 214. The air flowing into the dust bin 215 of the first cleaner 200 may move the remaining dust in the dust bin 215 downward and collect it into the dust storage unit 130. Accordingly, the suction power of the first cleaner 200 may be improved by preventing residual dust from remaining in the dust bin 215. In addition, by preventing the residual dust from remaining in the dust bin 215, the odors generated by the residue may be removed.

The second flowing part 176 may include a discharge part 1762 for discharging air and a fourth driving unit that rotates the discharge part 1762 with respect to the first axis 1761. Since the discharge part 1762 rotates about the first axis 1761 and flows air to various areas of the dust bin 215, the residual dust in the dust bin 215 can be efficiently removed.

Referring to FIGS. 20 and 21, the station 100 according to another exemplary embodiment of the present specification may include removal parts that moves to the inside of the dust bin 215 and removes the remaining dust inside the dust bin 215.

Referring to FIG. 20, the removal parts may include a first removal member 177. The first removal member 177 may rotate based on the central area of the dust bin 215 and scrape off the residual dust in the dust bin 215.

Referring to FIG. 21, the removal parts may include a second removal member 178. The second removal member 178 may move from the top to the bottom of the dust bin 215 and scrape off the residual dust in the dust bin 215.

Accordingly, the suction power of the first cleaner 200 may be improved by preventing residual dust from remaining in the dust bin 215. In addition, by preventing residual dust from remaining in the dust bin 215, the odors generated by the residue may be removed.

Referring to FIGS. 24 and 25, the station 100 according to one embodiment of the present specification may include a holder 400. The holder 400 may extend in the vertical direction. The holder 400 may be detachably coupled to the housing 110. Alternatively, the holder 400 may be integrally formed with the housing 110. The first cleaner 200 may be held by the holder 400. The holder 400 may support the first cleaner 200.

The holder 400 may include a main part 410. The main part 410 may be disposed on the supporting part 420. The main part 410 may be disposed on the supporting part 420. The main part 410 may be supported by the supporting part 420. The main part 410 may be detachably coupled to the supporting part 420. The first cleaner 200 may be coupled to the main part 410. The main part 410 may charge the battery 230 of the first cleaner 200.

The holder 400 may include a supporting art 420. The supporting part 420 may be detachably coupled to the housing 110. Alternatively, the supporting part 420 may be integrally formed with the housing 110. The supporting part 420 may support the main part 410. In the exemplary embodiment of the present specification, the supporting part 420 is described as being formed on the side of the housing 110, but the present disclosure is not limited thereto, and the supporting part 420 may be disposed on the upper surface of the housing 110. In addition, in one embodiment of the present specification, the supporting part 420 is described as an example that is formed in a hexahedral shape extending in the vertical direction, but the shape of the supporting part 420 can be variously changed if it can support the main part 410.

The holder 400 may include a locking part 430. The locking part 430 may be disposed on the upper part of the main part 410. The locking part 430 may be coupled with the first cleaner 200 to stably fix the first cleaner 200. The locking part 430 may include a plurality of locking members spaced apart in a horizontal direction. The main body 210 of the first cleaner 200 may be fitted in a space between the plurality of locking members from above. In this case, the inner surface of the locking part 430 may be slidably coupled to the outer surface of the main body 210 of the first cleaner 200. A sliding groove may be formed on an inner surface of the locking part 430, and a sliding protrusion that is slidably coupled to the sliding groove of the locking part 430 may be formed on an outer surface of the main body 210 of the first cleaner 200. Alternatively, a sliding protrusion may be formed on the inner surface of the locking part 430, and a sliding groove may be formed on the outer surface of the main body 210 of the first cleaner 200.

An extra cleaning module 500 may be disposed on the holder 400. The extra cleaning module 500 may be detachably coupled to the holder 400. In general, the first cleaner 200 may variously include replaceable cleaning modules 290, 510, and 520 according to usage. Accordingly, the unused extra cleaning modules 510 and 520 may be stored in a state coupled to the holder 400 to reduce the risk of loss. The extra cleaning modules 510 and 520 may be referred to as 'accessories'.

Referring to FIG. 26, the coupling body 120 of the station 100 according to one embodiment of the present specification may be separated. Specifically, the coupling body 120 and the first door member 112 of the station 100 may be detachably coupled to the housing 110. When the coupling body 120 is removed, the dust storage unit 130 disposed in the housing 110 may be exposed upward, and a user may use the station 100 as a general trash. In addition, when the dust storage unit 130 is filled with dust, the user can easily remove and/or replace the dust storage unit 130, thereby providing user convenience.

Referring to FIG. 27, the station 100 according to one embodiment of the present specification may include a second door member 195. The second door member 195 may be disposed on the side of the station 100. The second door member 195 may communicate with the dust storage unit 130. Specifically, when the second door member 195 is opened, the dust storage unit 130 may be exposed to an outside, and thus, a user may use the station 100 as a general trash. In addition, when the dust storage unit 130 is filled with dust, the user can easily remove and/or replace the dust storage unit 130, thereby providing user convenience.

The embodiments of the present specification have been described above with reference to the accompanying drawings, but those of ordinary skill in the art to which the present specification pertains can understand that it can be implemented in other specific forms without changing the technical spirit or essential features. Therefore, it should be understood that the embodiments described above are illustrative and non-limiting in all respects.

The invention claimed is:

1. A station to which a cleaner including a dust bin and a body cover selectively opening and closing a lower surface of the dust bin is coupled, the station comprising:

a housing;

a coupling body disposed on an upper portion of the housing and configured to be coupled to the dust bin and forming a predetermined angle with a bottom surface of the station;

a separator disposed on an upper portion of the coupling body and configured to separate the body cover from the dust bin;

a driver disposed in the housing and configured to rotate the coupling body with respect to the bottom surface of the station; and a dust storage disposed in the housing and disposed under the coupling body.

2. The station of claim 1, further comprising a sensor disposed in the coupling body and configured to detect whether the dust bin is coupled to the coupling body, wherein when the dust bin is detected by the sensor as being coupled to the coupling body, the driver rotates the coupling body.

3. The station of claim 1, further comprising:

a rotation shaft connected to the driver;

a first gear connected to the rotation shaft; and a second gear connected to the coupling body and engaged with the first gear.

4. The station of claim 3, wherein when the first gear rotates in a first direction, the coupling body rotates towards the bottom surface of the station, and wherein when the first gear rotates in a second direction opposite to the first direction, the coupling body rotates away from the bottom surface of the station to form the predetermined angle with the bottom surface of the station.

5. The station of claim 1, wherein the coupling body includes:

a coupling surface extending in the predetermined angle and configured to be coupled to the lower surface of the dust bin; and an opening and closing member disposed on the coupling surface and disposed under the body cover for selectively opening and closing at least a part of the coupling surface.

6. The station of claim 5, further comprising:

a rotation shaft connected to the driver;

a first gear connected to the rotation shaft; and a third gear connected to the opening and closing member and engaged with the first gear.

7. The station of claim 6, wherein when the first gear rotates in a first direction, the opening and closing member rotates to form the predetermined angle with the coupling surface, and wherein when the first gear rotates in a second direction opposite to the first direction, the opening and closing member rotates to be parallel with the coupling surface.

8. The station of claim 7, wherein when the first gear rotates in the second direction, the opening and closing member is configured to couple the body cover to the dust bin.

9. The station of claim 1, wherein the separator disposed on the upper portion of the coupling body includes a separating member protruding inwardly from an inner side surface of the station, and wherein when the coupling body rotates towards the bottom surface of the station, a coupling lever of the cleaner that couples the body cover to the dust bin is engaged by the separator and is separated from the dust bin.

10. The station of claim 9, wherein the separator is provided on the coupling body, wherein the separator includes a transmission member disposed between the separating member and the coupling lever of the cleaner, wherein a first side of the transmission member is disposed under the separating member, and wherein a second side of the transmission member is disposed above the coupling lever of the cleaner.

11. The station of claim 10, wherein a lower part of the second side of the transmission member maintains contact with an upper side of the coupling lever of the cleaner, and wherein when the coupling body rotates towards the bottom surface of the station, an upper part of the first side of the transmission member contacts a lower part of the separating member, and the second side of the transmission member presses the coupling lever downward to separate the body cover from the dust bin.

12. The station of claim 10, wherein the transmission member includes a vertical portion which connects the first side of the transmission member to the second side of the transmission member.

13. The station of claim 12, wherein the vertical portion of the transmission member includes a lower part and an upper part, and wherein the lower part of the vertical portion of the transmission member includes a step portion disposed closer to the separating member than the upper part of the vertical portion of the transmission member.

14. The station of claim 10, wherein the coupling body includes a coupling surface extending in the predetermined angle with the bottom surface of the station, the coupling surface being configured to be coupled to the lower surface of the dust bin, and wherein when the coupling body is disposed parallel with the bottom surface of the station, the separating member is disposed under the coupling surface.

15. The station of claim 1, wherein the coupling body includes:

a coupling surface extending in the predetermined angle with the bottom surface of the station and configured to be coupled to the lower surface of the dust bin; and a guide part connected to the coupling surface and having a shape corresponding to an outer surface of the dust bin, and wherein the separator protrudes inwardly from an inner side surface of the guide part.

16. A dust removal system comprising:

a cleaner including:

a main body;

a suction unit protruding outward from the main body;

a suction motor configured to generate a suction force for pulling in air through the suction unit;

a dust separator configured to separate dust from the air introduced through the suction unit;

a dust bin configured to store the dust separated from the dust separator;

a body cover configured to selectively open and close a lower surface of the dust bin; and a compressor formed along an inner circumferential surface of the dust bin and configured to move an inner space of the dust bin to compress the dust in the dust bin; and a station including:

a coupling body coupled to the dust bin and arranged at a predetermined angle with respect to a bottom surface of the station;

a separator configured to separate the body cover from the dust bin;

a driver configured to rotate the coupling body with respect to the bottom surface of the station; and a dust storage disposed under the coupling body.

17. The dust removal system of claim 16, further comprising a sensor configured to detect whether the dust bin is coupled to the coupling body, wherein the driver is configured to rotate the coupling body when the dust bin is detected by the sensor as being coupled to the coupling body.

18. The dust removal system of claim 16, further comprising:

a rotation shaft connected to the driver;

a first gear connected to the rotation shaft; and a second gear connected to the coupling body and engaged with the first gear.

19. The dust removal system of claim 18, wherein when the first gear rotates in a first direction, the coupling body rotates towards to the bottom surface of the station, and wherein when the first gear rotates in a second direction opposite to the first direction, the coupling body rotates away from the bottom surface of the station to form the predetermined angle with the bottom surface of the station.

20. The dust removal system of claim 18, wherein the coupling body includes:

a coupling surface extending in the predetermined angle and configured to be coupled to the lower surface of the dust bin;

an opening and closing member disposed under the body cover and configured to selectively open and close at least a part of the coupling surface; and a third gear connected to the opening and closing member and engaged with the first gear, wherein when the first gear rotates in a first direction, the opening and closing member rotates to form the predetermined angle with the coupling surface, and wherein when the first gear rotates in a second direction opposite to the first direction, the opening and closing member rotates to be parallel with the coupling surface.

* * * * *